US012059105B2

(12) United States Patent
Denton

(10) Patent No.: US 12,059,105 B2
(45) Date of Patent: Aug. 13, 2024

(54) COMBINED SHOWER AND TOILET

(71) Applicant: Clive Denton, Saint Zacharie (FR)

(72) Inventor: Clive Denton, Saint Zacharie (FR)

( * ) Notice: Subject to any disclaimer, the term of this patent is extended or adjusted under 35 U.S.C. 154(b) by 236 days.

(21) Appl. No.: 17/609,041

(22) PCT Filed: May 11, 2020

(86) PCT No.: PCT/EP2020/063079

§ 371 (c)(1),
(2) Date: Nov. 5, 2021

(87) PCT Pub. No.: WO2020/229423

PCT Pub. Date: Nov. 19, 2020

(65) Prior Publication Data

US 2022/0202260 A1 Jun. 30, 2022

(30) Foreign Application Priority Data

May 10, 2019 (GB) ..... 1906607

(51) Int. Cl.
*A47K 4/00* (2006.01)
*A47K 3/32* (2006.01)
*A47K 10/38* (2006.01)

(52) U.S. Cl.
CPC ..... *A47K 4/00* (2013.01); *A47K 3/325* (2013.01); *A47K 10/38* (2013.01)

(58) Field of Classification Search
CPC ..... A47K 1/02; A47K 17/00; A47K 17/028; A47K 3/40–405; A47K 4/00; B60R 15/02–04; E03C 1/01
(Continued)

(56) References Cited

U.S. PATENT DOCUMENTS 4,635,303 A * 1/1987 Shih ..... G09B 19/0076 4/235
5,742,956 A * 4/1998 Tarver ..... A47K 4/00 4/663
(Continued)

FOREIGN PATENT DOCUMENTS

CN 2037386 5/1989
DE 3242574 * 6/1983 ..... A47K 4/00
(Continued)

OTHER PUBLICATIONS

International Search Report For PCT/EP2020/063079 Mailing Date Oct. 22, 2020.
Examination Report For GB 2106827.5 Report Dated Jun. 21, 2021.

*Primary Examiner* — David P Angwin
*Assistant Examiner* — Nicholas A Ros
(74) *Attorney, Agent, or Firm* — Neil D. Gershon

(57) ABSTRACT

A combined shower and toilet arrangement 10 comprises a shower, comprising: a shower fluid outputting arrangement 12; and a shower floor 14; and: a toilet 16, comprising a receiving area 19 for receiving human waste; wherein the combined shower and toilet arrangement is operable in a shower use mode or a toilet use mode, wherein, in the toilet use mode, the shower floor is in a position that does not obstruct use of the toilet, and is in a non-use position, not usable as a floor for the shower; and in the shower use mode, the shower floor 14 is in a shower use position, above a portion or a whole of the receiving area of the toilet 16, and is usable as a floor for the shower.

14 Claims, 11 Drawing Sheets

(58) Field of Classification Search
USPC ..... 4/663–664
See application file for complete search history.

(56) References Cited

U.S. PATENT DOCUMENTS

| | | | | |
|---|---|---|---|---|
| 9,340,963 | B2 * | 5/2016 | Ito | E04H 1/1266 |
| 2009/0320204 | A1 * | 12/2009 | Wiseman | A47K 3/40 4/613 |
| 2017/0112338 | A1 * | 4/2017 | Cheng | A47K 17/028 |
| 2019/0099046 | A1 * | 4/2019 | Williams | A47K 4/00 |

FOREIGN PATENT DOCUMENTS

| | | | | |
|---|---|---|---|---|
| FR | 1032764 | * | 7/1953 | A47K 4/00 |
| FR | 1035898 | * | 9/1953 | A47K 4/00 |
| FR | 2263342 | * | 10/1975 | A47K 4/00 |
| FR | 2264509 | * | 10/1975 | A47K 4/00 |
| IT | CZ20 110 006 | | 10/2012 | |
| KR | 200467199 | | 6/2013 | |
| WO | WO 2005/053490 | | 6/2005 | |
| WO | WO2018077816 | * | 5/2018 | A47K 4/00 |
| WO | WO 2019/077435 | | 4/2019 | |
| WO | WO2019077435 | * | 4/2019 | A47K 4/00 |

* cited by examiner

COMBINED SHOWER AND TOILET

This application is a 371 of PCT/EP2020/063079, filed on May 11, 2020, which claims benefit of GB 1906607.5, filed on May 10, 2019. The entire contents of each of these applications are hereby incorporated by reference herein.

TERMS/DEFINITIONS

'Arrangement':

The term arrangement is a technical term which means a feature, or combination of features, (usually with a given purpose). For example, a 'measuring arrangement' is a feature or features, to facilitate measuring. A 'holding arrangement' is a feature or features, to facilitate holding.

'Feature':

The term 'feature' is a broad term that includes within its scope any feature under the Sun. A feature may, for example, be an element, body, member, or may even be an aperture (eg opening/hole/gap or the such like). Thus the term 'holding feature' includes within its scope, for example, any element, body, member, or even aperture, to facilitate holding. A 'feature' may also be a 'part' of a broader feature; for example, if a part of an invention is disclosed/claimed as comprising a 'padding feature', this does not limit the padding feature to being a separate feature that is added to the invention (eg a sponge element, adhered to the invention); the invention, for example, may have a part made of sponge, or have an inner sponge (or soft) layer—in such a case, if that part of the invention is clearly of a material/nature that provides padding, then this falls within a scope of what is defined in the present application as a 'padding feature'.

'Substantially':

It is known, to those with skill in the art of patenting, that the word 'substantially' can, in some instances, be used to broaden a term. It should be stated that, in the present application, use of the word 'substantially' with a term, to define a (characterizing) feature(s), gets all the benefit (ie the benefit of any broadening) afforded by use of the word 'substantially', and also includes within its scope the feature(s) being that term exactly, (without broadening). For example, if two features are described/defined in the present application as being 'substantially parallel', then that includes, within its scope, the features being 'close' to parallel (in so far as the word 'substantially' is deemed to broaden the term 'parallel'), and also includes within its scope the features being 'exactly' parallel).

'Attached' and 'Connected':

If a feature (or two features) are defined in a claim as being attached, that would include within its scope the feature (or two features) being permanently attached, (of course), and would also include within its scope the feature (or two features) being removably attachable, (because, if removably attachable, the feature (or two features) can be attached, and therefore, when attached, would be within a scope of being 'attached'). Furthermore, the feature (or two features) being defined in a claim as being 'attached' would also include within its scope the feature that is defined as being 'attached' being formed as one part with a portion or a whole of the other feature it is defined as being 'attached' to. For example, if a table leg is defined in a claim as being 'attached' to a table top, that would include within its scope the table leg being formed as one part with a whole of the table top (eg if the table leg and table top were formed as one piece of plastic, for example) and would also include within its scope the table leg being formed as one part with a portion (rather than a whole) of the table top (eg if the table top was formed of more than one part, and the table leg was formed as one part with a part of the table top, but not a whole of it).

It should be noted, some (few) patent offices require structural connection/relationship terms (in claims), to define structural connection/relationship between features of the claim. With this in mind, (and if it should be required, although it often is not), the term 'connected', if used in a claim, is a broad term, which includes within its scope direct connection, and also includes within its scope indirect connection. ('Direct' connection would be where two features, for example, are directly connected to each other (eg an arm is 'directly' connected to a shoulder). 'Indirect' connection would be where two features, for example, are connected, but via intermediate feature(s) (eg a person's foot is 'connected' to their head, but 'indirectly', (via their leg, abdomen, torso, etc, which are 'intermediate features')). Where the term 'connected' is used in a claim, it includes within its scope 'direct' connection, and also includes within its scope 'indirect' connection. The term may be used in a claim, (and is deemed supported), whether 'direct' and/or 'indirect' connection embodiment(s) is (/are) disclosed in the present application, and, as stated, includes within its scope 'direct' connection, and also includes within its scope 'indirect' connection. Furthermore, if a feature(s) is (/are) defined as being 'connected', that would include within its scope the (or any—ie more than one of the said) feature(s) being removably attachable, if, when attached, the feature(s) is (/are) in a state of being 'connected', (directly or indirectly). Thus if a first feature is defined as being 'connected' to a second feature, it would include within its scope the first feature and/or the second feature being removably attachable, if, when attached, the first feature is connected to the second feature, (directly or indirectly). Furthermore, of course, (and similarly to the word 'attached'), if a feature (or two features) are defined in a claim as being 'connected' it would also include within its scope the feature that is defined as being 'connected' being formed as one part with a portion or a whole of the other feature it is defined as being 'connected' to.

'The or Each' and 'the or Any':

The term 'the or each' (either in disclosure and/or a claim) can refer back to a single feature/thing, and/or can refer back to a plurality of features/things. When the term is read as referring back to a plurality of features/things, it should be taken as meaning, and including within its scope, 'at least one, or more, or all (ie each)' of the said features/things. Thus, to give an example, if a square is referred to/disclosed that has four corners, if the term 'the or each corner' is used, it includes within its scope 'one of the corners, (or two, or three, or all of the corners)'.

When any one feature/thing is afforded any feature(s)/definition in the present application, it is taken as read that, where a plurality of the said feature/thing is provided, 'the or each' said feature/thing may be provided/claimed comprising the said feature(s)/definition (ie at least one, or more or all). Similarly, wherever a plurality of the said feature/thing are afforded any feature(s)/definition, it is taken as read that 'the or each' said feature/thing may be provided/claimed comprising the feature(s)/definition (ie at least one, or more, or all of the plurality), and/or that even just one said feature/thing may be provided/claimed comprising the feature(s)/definition in an embodiment/claim wherein an invention is defined as comprising 'a' (eg singular) said feature/thing.

(The term 'the or any' may be used (again including within its scope, 'at least one, or more, or all (ie each)', instead of the term 'the or each').

'User Means':

It will be well known that, in certain patenting territories, (for example, the United States), use of the term 'means' or 'means for', if used in a (granted) patent claim, can be seen as a limiting term, limited to only giving the applicant/proprietor of the patent protection of means that are disclosed in the granted patent, or 'equivalent' means. This is not the case with the term 'user means' as it is used in the present application. The term 'user means' is a very broad term that is used in the field of product design/user-interface, and defines any means under the sun, provided for a user, for whatever action/result the user means is provided for. For example—a 'user means' to turn on a television could be provided by way of an ON/OFF button on the television. But it could also be provided by a button on a remote control which turns on the television when pressed. Both of these would fall (in the technical field of product design/user-interface) under the scope of the term 'user means' to turn on the television. Similarly, with certain inventions/products, a 'user means' may be provided to 'initiate' an action, for example. Thus, in the present application, a claim that defines an invention which comprises a 'user means' for [a particular action/result] is not subject to any 'means for' limitations that certain patent office territories (such as the United States) may appropriate to the term 'means for', but should be read as (and given protection for, if granted) any means under the sun, provided for a user, for [that particular action/result defined]. 'User means' is a technical term in the field of product design/user-interface.

Reference to Multiple Similar Elements in Plural

In the present application, there may be provided/numbered features wherein the same primary number is used, with a suffix. For example, a first side of the/an invention may be numbered 600', and a second side of the/an invention numbered 600". In any such case (or where any other suffix is used, such as 'L' and 'R' to denote 'left' and 'right', or 'a' and 'b', for example), when such features are referred to together (ie 'the sides'), the plural may be numbered/referred to with the primary number (without the suffix). Thus the first side 600' and second side 600" may, for example, be referred to simply as 'the sides 600'. Furthermore, if a side is referred to (not specifying which one of the sides), the primary number (ie 600, for example) may be used, without any suffix.

BACKGROUND

Regular toilets have only one use—the receiving of human body waste. Similarly, showers tend to have just one use—for showering, for the user to clean themselves.

For various reasons, (including the ability to save space, which could be extremely useful (and valuable)), it would be desirable if a solution could be provided, to allow for usage both of a toilet, and a shower, whilst saving space.

SUMMARY

The present invention is defined by the accompanying claims, to which reference should now be made.

Examples of the present invention seek to provide a solution to any or all of the above problem(s), by providing: a combined shower and toilet arrangement, comprising: a shower, comprising: a shower fluid outputting arrangement; and a shower floor; and: a toilet, comprising a receiving area for receiving human waste; wherein the combined shower and toilet arrangement is operable in a shower use mode or a toilet use mode, wherein: in the toilet use mode, the shower floor is in a position that does not obstruct use of the toilet and is in a non-use position, not usable as a floor for the shower; and in the shower use mode, the shower floor is in a shower use position, above a portion or a whole of the receiving area of the toilet, and is usable as a floor for the shower.

(In the present application, the word/noun 'toilet' is used as a broad term, to mean any arrangement that a user may defecate into. Thus, whilst in the western world, toilets to defecate into tend to always have a raised unit (raised from the ground), comprising a seat and a basin (the basin is often also referred to/defined as a 'pan') for the user to defecate into, (and tend to have flushing systems, to evacuate the waste), even toilets that tend to be of a much more basic structure (eg what are often referred to as 'squat' toilets), which may not be (or may hardly be) raised from the ground, and where the user may 'squat' and defecate into a hole that is substantially at ground level, and which are prevalent in some parts of the world) are within the scope of being a toilet. (It will be apparent that many different toilets may also be used for urinating into). The term 'toilet' also does not require that there is a flushing system, for evacuating human waste. However, it will be apparent that a flushing system tends to be highly desirable for a toilet).

The shower fluid will tend, (in nearly all cases), to just be water. However, it could feasibly be a mix, including, for example, cleaning agents, (such as soap, etc, which may aid cleaning of the user).

The receiving area will tend to comprise an opening (or openings), (which may be broadly defined as an aperture(s)), for receiving human waste, (eg defecation, or urine, for example). However, toilets of strange shape, design, etc may be provided/used, which may not have such clearly defined opening(s). For example, in some less affluent countries, there may be very simple receiving areas, which may be less defined, (and not mechanically constructed), for example, for receiving waste of the user.

The combined shower and toilet arrangement may be particularly useful in small living areas, (such as condominiums or hotel rooms, for example). It could also be useful/appropriate for office facilities, to enable staff to shower, eg following physical efforts coming into work, such as cycling. A shower and toilet could therefore be provided, in such a case, in a very limited space. (However, it should be stated, the combined shower and toilet arrangement is not limited to small living spaces).

Preferably, the shower floor is rotatably movable from the non-use position to the shower use position; and from the shower use position to the non-use position.

Preferably, the shower floor is rotatably movable from the non-use position to the shower use position, and from the shower use position to the non-use position, rotatably movable from behind the receiving area of the toilet; wherein rotation of the shower floor is configured so that a whole of the receiving area of the toilet is within a circular trajectory of an arc of rotation of the shower floor as it rotates from the non-use position to the shower use position, the whole of the receiving area of the toilet thus being under the shower floor when the shower floor is in the shower use position. This differentiates, for example, from EGHFAIER, Mohamed (WO2019/077435 At), (which will now be referred to simply as EGHFAIER). IN EGHFAIER, the shower floor is rotatably movable from the non-use position to the shower use position, and from the shower use position to the non-use position, rotatably movable from behind the receiving area of the toilet. However, looking at FIG. 2B of EGHFAIER, one can see that the shower floor of EGHFAIER is in a raised position. One can see, (by virtue of FIG. 2A of EGHFAIER) that, when rotated down from this position, the whole of the receiving area of the toilet is not 'within a circular trajectory of an arc of rotation of the shower floor as it rotates from the non-use position to the shower use position'. This is clear, because we can even clearly see the receiving area of the toilet in FIG. 2A of EGHFAIER. (And the rotational arrow shown in FIG. 2B of EGHFAIER demonstrates the rotational movement of the shower floor, in combination with FIG. 2A even more clearly showing, then, that rotation of the shower floor, in EGHFAIER, is not configured so that a whole of the receiving area of the toilet is within a circular trajectory of an arc of rotation of the shower floor as it rotates from the non-use position to the shower use position.

It should be noted, there are many (potentially important) benefits of rotation of the shower floor being configured so that a whole of the receiving area of the toilet is within a circular trajectory of an arc of rotation of the shower floor as it rotates from the non-use position to the shower use position. Perhaps the most important benefit is compactness. It will be apparent that a combined shower and toilet arrangement has the potential to save a lot of space, (especially over having a separate toilet and shower). For this reason, it may be particularly desired where space-saving is at a premium. Examples of this may include, for example, novelty compact hotels, or extreme compact-housing type housing, which has becomes more popular in recent times, and often includes individually-built (although it could include mass-produced) housing, which uses many tricks (in terms of design, engineering, etc) to build a liveable space in extremely compact dimensions. Other benefits may include, for example, in transportable embodiments. For example, is a transportable embodiment(s) is used at a festival(s), it may be extremely beneficial if the whole unit is extremely compact. Rotation of the shower floor being configured so that a whole of the receiving area of the toilet is within a circular trajectory of an arc of rotation of the shower floor as it rotates from the non-use position to the shower use position gives a benefit (eg over EGHFAIER), because the whole unit could be extremely compact (in the front/back orientation). Looking at FIG. 2A of EGHFAIER, it can be seen that it is not particularly compact in the front/back orientation, with the shower floor clearly extending outwards significantly at the front. This is a significant disadvantage in terms of compactness, and therefore could even be argued to slightly erode one of the main benefits of a combined shower and toilet arrangement, (ie compactness).

According to a second aspect of the invention, there is provided a combined shower and toilet arrangement, comprising: a shower; and a toilet. (All other feature(s) and/or combination of feature(s) disclosed in the present application are optional with regards to this aspect of the invention).

The second aspect (and/or any further/other aspect(s)) may comprise any of the feature(s) of the first aspect and may draw upon any of the feature(s) and/or disclosure of the present application, as optional and/or preferable feature(s). Any aspect may comprise any feature(s) of any other aspect(s), whether the feature(s) be essential or preferable and/or optional to the other aspect(s).

BRIEF DESCRIPTION OF THE DRAWINGS

Examples of the present invention will now be more particularly described, with reference to the accompanying drawings, by way of example only, in no way limiting a scope of the invention, in which.

Figure 1:
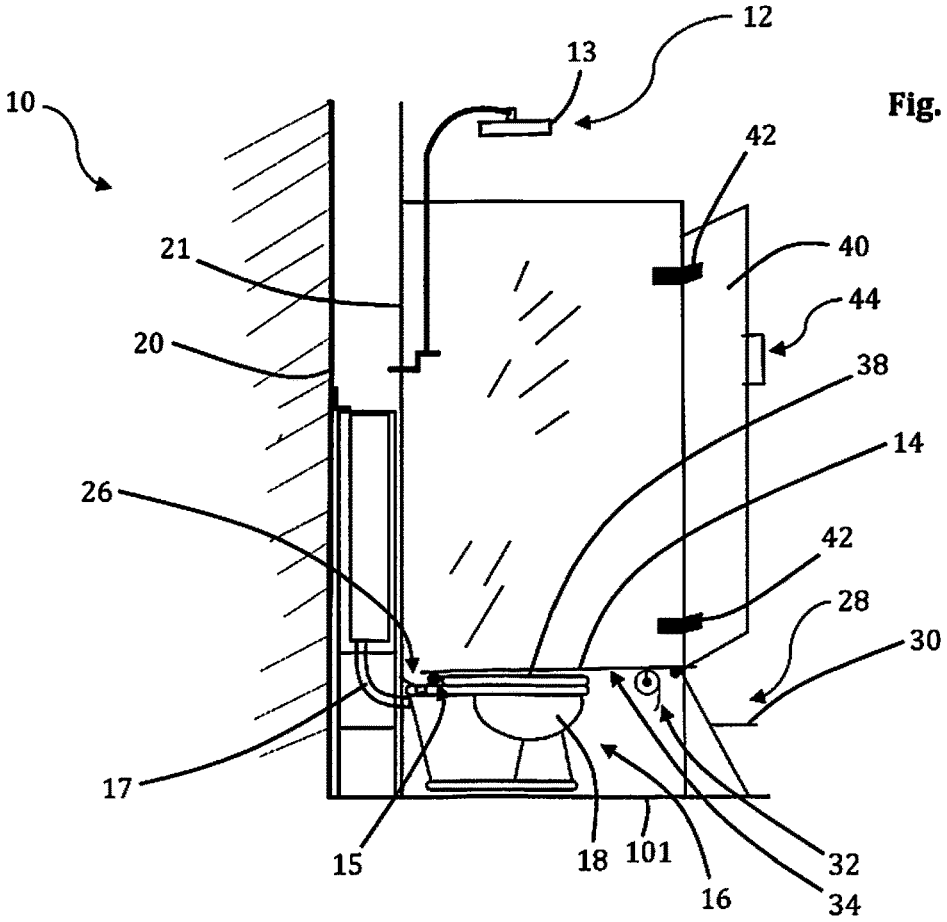
FIG. 1 is a side open-plan view of an embodiment of a combined shower and toilet arrangement, shown in a shower use mode, with a shower floor shown above a portion or a whole of a toilet, (and shown above a closed toilet seat in the example)

Nate: At some patent offices, when claim(s) are allowed for patent, it is required that Figures that show embodiments that do not comprise all the features of the/an invention claimed are denoted as 'not being claimed' or 'not within a scope of what is claimed' (or words to that effect). Even in such case, it will be apparent that such Figure(s) may or do show feature(s) that are essential, or preferable and/or optional, to the/an invention claimed, which will be apparent, in light of the disclosure. Thus such Figure(s) (and/or disclosure related to such Figure(s) and/or embodiment(s)), should nevertheless be considered relevant to the/an invention claimed.

DETAILED DESCRIPTION

Referring to the drawings, there is shown a combined shower and toilet arrangement 10, comprising: a shower, comprising: a shower fluid outputting arrangement 12; and a shower floor 14; and: a toilet 16, comprising a receiving area 19 for receiving human waste; wherein the combined shower and toilet arrangement is operable in a shower use mode or a toilet use mode, wherein: in the toilet use mode, the shower floor is in a position that does not obstruct use of the toilet, and is in a non-use position, not usable as a floor for the shower; and in the shower use mode, the shower floor 14 is in a shower use position, above a portion or a whole of the receiving area of the toilet 16, and is usable as a floor for the shower.

(The term 'non-use position', when used here with reference to the shower floor, simply means that it is not usable as a floor for the shower).

Figure 2:
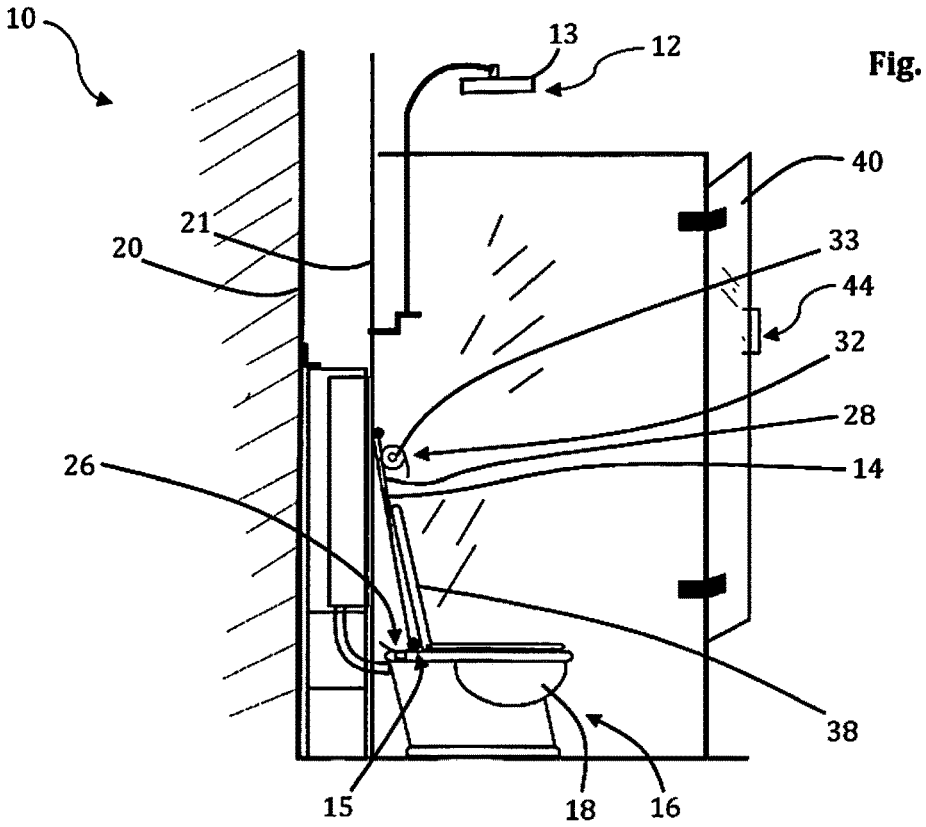
FIG. 2 is a same side open-plan view of the same embodiment of the combined shower and toilet arrangement as shown in FIG. 1, now shown in toilet use mode, with the shower floor now out of the way, and the toilet usable.

(In the example(s) in the drawings, the shower fluid outputting arrangement 12 comprises a shower head, (best shown in FIG. 1 and FIG. 2). However, it will be apparent that the shower fluid outputting arrangement 12 could be provided in many different ways, in no way limited to the example of a shower head. For example, it is even feasible that water may be outputted directly from the/a wall, onto the shower user in the shower. This, again, despite being very different from a shower head, would be an example of a shower fluid outputting arrangement 12. The fluid could feasibly be outputted from just one opening (and thus aperture), rather than a plurality (of apertures). (It should also be noted, the combined shower and toilet arrangement 10 may comprise any of the features associated with everyday showers; for example, it may have a handheld shower head, for example, (for use as part of shower fluid outputting arrangement 12). It may also comprise various shower fittings, (including taps, dials, etc)). (It should also be stated that, whilst, in the example(s) of the drawings, such example shower heads tend to comprise a plurality of outputting apertures (and thus fluid is outputted from the shower fluid outputting arrangement 12 via many apertures, (in a standard 'sprinkler' type outputting that is typical in many showers), it is feasible, for the combined shower and toilet arrangement, that fluid is outputted from just one aperture, rather than a plurality of apertures)). (In different embodiments, the fluid outputting arrangement may be positioned differently, which will be apparent).

(The or any shower fittings may include traditional fixtures and fittings associated with any other shower, for example. For example, means to initiate outputting of hot and cold water, (which could be achieved via a mixer tap, for example). There may be a shower head, for example. There may be a hand-held shower (head), for example. There may be any shower unit accessories. (it is feasible a hand-held shower head could be the only fluid outputting arrangement, (although, as will be known, a hand-held shower head is often provided as a secondary fluid outputting arrangement)).

Figure 5:
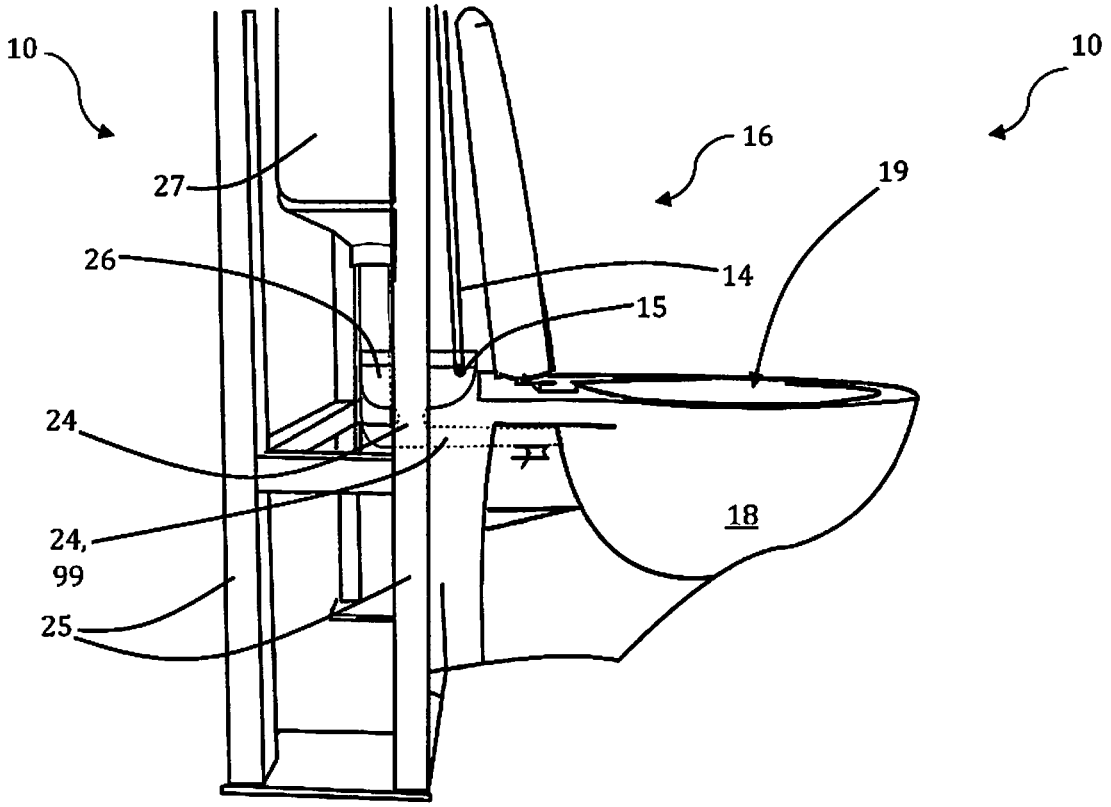
FIG. 5 is a side view, focusing particularly on an embodiment of a toilet, and showing an example, (shown in dashed lines), of a flow arrangement, which directs water from the shower into the example pan of the toilet.

In the example embodiment of FIG. 5, the receiving area 19 of the example toilet 16 is clearly shown. In the example, the toilet comprises a pan 18. Thus in the example, the receiving area 19 is a receiving area of a pan. However, not all toilets comprise a pan. For example, 'squat' toilets may or may not comprise a pan. (And if they (squat toilets) do comprise a pan, it will tend not to be a 'raised' (aboveground) pan, as in the example of FIG. 5). Thus the receiving area 19, (depending on whether the toilet embodiment comprises a pan), may or may not be a receiving area of a pan.

The shower floor may be movable (from the shower use position to the toilet use position) in any way; for example, in a most basic embodiment, the shower floor may be movable by a user as a separate part from the rest of the combined shower and toilet arrangement. Thus, the user could put the shower floor in the shower use position, to use the combined shower and toilet arrangement as a shower, and could then remove the shower floor, perhaps placing it on the bathroom floor, or leaning it against the bathroom wall, or storing it anywhere, so that the combined shower and toilet arrangement can then be used in the toilet use mode. However, this may be cumbersome. (In such a case/example, wherever the shower floor is placed/stored by the user when removed, that is the/a 'non-use position' of the shower floor).

Thus, preferably, the combined shower and toilet arrangement comprises a mechanism to facilitate moving the shower floor from the non-use use position to the shower use position. (In all the examples of the Figures, the combined shower and toilet arrangement comprises a mechanism to facilitate moving the shower floor from the non-use use position to the shower use position).

Preferably, the shower floor is rotatably movable from the non-use position to the shower use position. This is shown, by way of example only, in the drawings, and is best shown by virtue of the comparison between the position of the shower floor 14 in FIG. 1, and FIG. 2, where it has been shown rotatably moved from the shower use position (FIG. 1) to the non-use use position (FIG. 2). Thus, preferably the combined shower and toilet arrangement comprises a rotation arrangement, to facilitate the shower floor being rotatably movable from the non-use position to the shower use position. (As stated, this is shown, by way of example only, in the drawings, and is best shown by virtue of the comparison between the position of the shower floor 14 in FIG. 1, and FIG. 2, where it has been shown rotatably moved from the shower use position (FIG. 1) to the non-use use position (FIG. 2)).

(The term 'mechanism', for the sake of the present application, is a broad term. Thus the term 'mechanism to facilitate moving the shower floor from the non-use use position to the shower use position' includes within its scope any arrangement to facilitate moving the shower floor from the non-use use position to the shower use position. (Any mechanism need not be complex, and may be extremely simple in nature, (or may feasibly be more complex in nature). The term 'rotation arrangement' (to facilitate the shower floor being rotatably movable from the non-use position to the shower use position) is here used, (rather than the term 'rotation mechanism'), simply to avoid any person(s) reading undue limitation on the term 'mechanism'. However, as stated, the term 'mechanism', in the present application, is an extremely broad term. Thus any example of a rotation arrangement (to facilitate the shower floor being rotatably movable from the non-use position to the shower use position) is also considered to be an example of a rotation 'mechanism' (to facilitate the shower floor being rotatably movable from the non-use position to the shower use position), (thereby comprising a feature or features, to facilitate the shower floor being rotatably movable from the non-use position to the shower use position), however simple or complex it may be. Thus even an extremely simple mechanism would be within this scope. For example, even an example as simple, for example, as there being provided an aperture, for example, that a portion of the shower floor fits into, allowing for rotation of the shower floor (from the non-use position to the shower use position, (and vice versa)) would be an example both of a 'rotation arrangement' and a 'rotation mechanism'. (Similarly, an example may be provided wherein, for example, a portion of the shower floor partially or wholly surrounds a feature(s) (eg a cylindrical feature/element, for example, or any relevant shape/feature(s)), and either the shower floor (by virtue of partially or wholly surrounding the feature(s)) can rotate around the feature(s), (and/or the feature(s) that is partially or wholly surrounded (or connected to (by the shower floor) in any way, for example) itself may be able to rotate, (thus facilitating rotation of the shower floor). Thus the term 'mechanism', in the present application, is a broad term, and no undue limitation should be read on it). In the example of FIG. 1 and FIG. 2, for example, there is thus provided a rotation arrangement, to facilitate the shower floor being rotatably movable from the non-use position to the shower use position, and this may also be said to be an example of a rotation mechanism, to facilitate the shower floor being rotatably movable from the non-use position to the shower use position. In various of the Figures, the rotation arrangement (and hence the rotation mechanism) comprise a hinge(s), which is an example provided by way of example only.

In various embodiments in the Figures, the combined shower and toilet arrangement is shown comprising a rotation arrangement, to facilitate rotatably moving the shower floor, (from the shower use position to the non-use position, (and vice versa)). The rotation arrangement may comprise a hinge(s). An example hinge 15 (and/or hinge fulcrum area 15) is shown and denoted in various of the Figures.

Thus, preferably, the rotation arrangement comprises a hinge mechanism.

Figure 6:
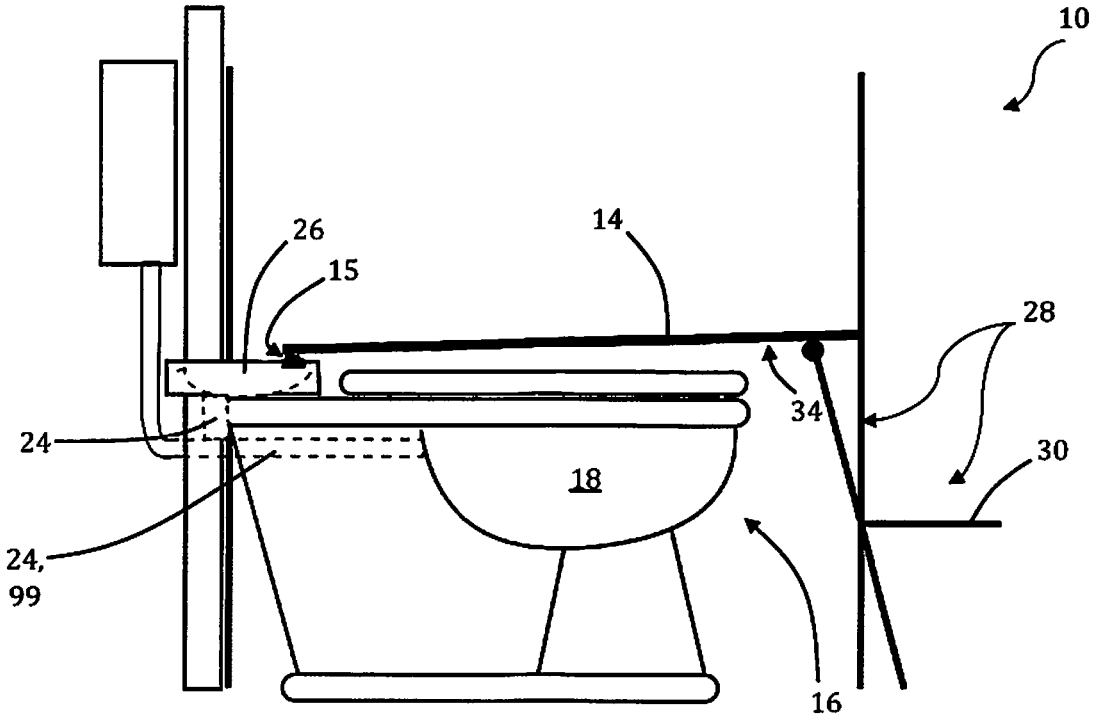
FIG. 6 is a side view, again showing an example, (shown in dashed lines), of a flow arrangement, which directs water from the shower into the example pan of the toilet, and showing an example of a shower floor that is sloped (and is angled in the example), to facilitate drainage of water from the shower off the shower floor.

An example of a hinge(s) 15 is also shown in FIG. 6. All the examples shown show examples of a mechanism to facilitate moving the shower floor from the non-use position to the shower use position (and thus vice versa).

Mechanisms to facilitate moving the shower floor from the non-use position to the shower use position are not limited to being to facilitate rotation. For example, it is feasible, (although not ideal in that it may take up more space), that the shower floor could be slid out of a wall (eg horizontally), and therefore could be slid from the non-use position (eg in a cavity/recess of the wall) to the shower use position, (and vice versa). Thus this would be an example of a slide arrangement. Thus movement of the shower floor is not limited to being done via rotation.

Preferably, in the toilet use mode, the shower floor 14 is in a substantially vertical position. (This is the case in all the example embodiments shown, and is best shown in FIG. 2 and FIG. 5). For the sake of the present application, the term 'substantially vertical' includes within its scope any angle within 20 degrees of exactly vertical. Preferably, in the toilet use mode, the shower floor 14 is within fifteen degrees of exactly vertical. It may, of course, be any angle closer to vertical, and may even be exactly vertical, in the toilet use mode.

Preferably, in the non-use position, the shower floor is able to extend beyond vertically. (This can allow it to simply use gravity to stay in the non-use position, whereas, if the shower floor did not extend beyond vertical, it may or would fall back down). (Best example shown of the shower floor extending beyond vertical in the non-use position is in FIG. 1, although FIG. 5 also shows this clearly).

Figure 4:
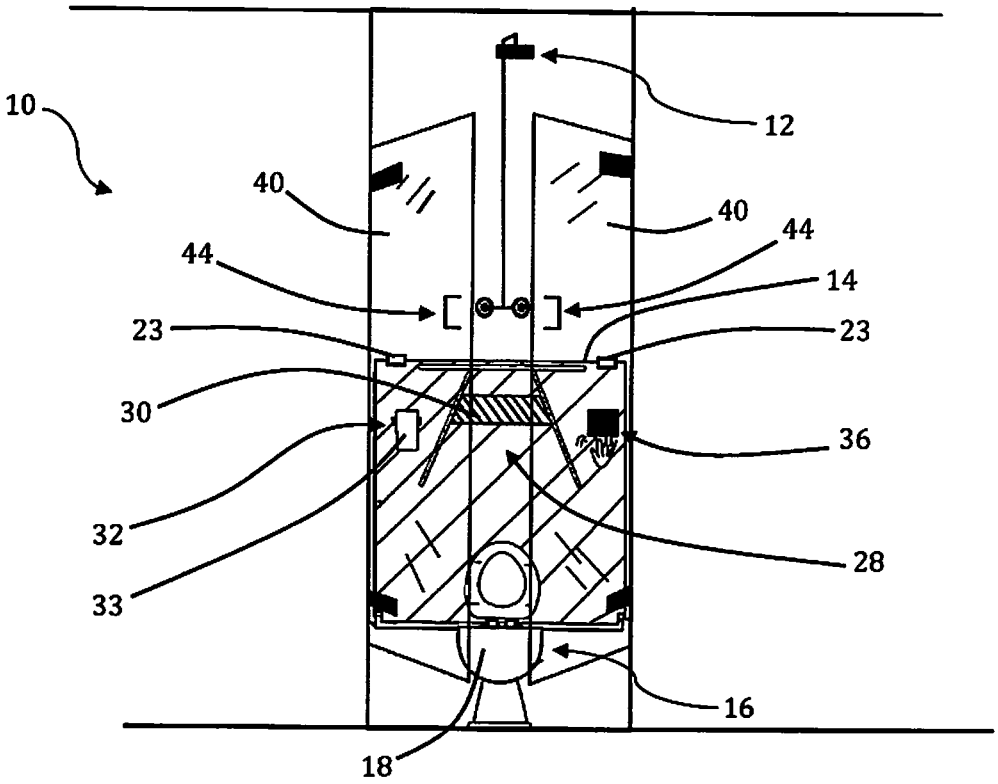
FIG. 4 is a front view of an embodiment, shown in toilet use mode, and showing an example that comprise feature(s) such as a toilet roll holder, (shown provided on an underside of the shower floor), and a touchless flush activation user means, (also shown provided on an underside of the shower floor)

Preferably, in the toilet use mode, (and thus in its non-use position), the shower floor 14 is behind a portion or a whole of the pan 18 of the toilet. (This is shown in all the example embodiments in the drawings). In the examples in the drawings, a whole of the shower floor 14 is behind a portion or a whole of the pan 18 of the toilet 16, in the toilet use mode. (The term 'behind' refers to, from a front view (ie from the view as shown in FIG. 4), a portion or a whole of the shower floor being behind the pan of the toilet. The term is not necessarily 'height' relevant, and, (in the non-use position), a portion or a whole of the shower floor (as shown in FIG. 4, for example, and other Figures) may be higher than the height of the pan of the toilet).

There may be a wall 20 (eg a back wall) of the room, behind the toilet 16. If there is a wall 20 (eg back wall) behind the toilet, preferably, in the toilet use mode, the shower floor 14 (in its non-use position) is substantially parallel to the back wall behind the toilet. For the sake of the present application, the term 'substantially parallel' means within twenty degrees of parallel. (Preferably it is within ten degrees of parallel). An example of the shower floor 14 being substantially parallel to the back wall behind the toilet, in the toilet use mode, is the example of FIG. 5, for example.

(It is feasible a wall 21 (eg back wall) of the combined shower and toilet arrangement and a wall 20 of the room are the same wall/feature. For example, in the example of FIG. 1, feature 21 and 20 could, in a different embodiment, be the same (ie just one) wall. Any features (such as the water/flush system, for example) shown between wall 20 and wall 21 could, in such an example, then be hidden, for example, behind and/or within that same wall that provides features 20 and 21. This example is given by way of example only, simply to display that various options are possible.

In FIG. 1 and FIG. 2, there is shown, by way of example only, a wall 21 (which in the example is a back wall) for/of the shower.

The combined shower and toilet arrangement 10 may comprise a holding arrangement, to hold the shower floor 14 in the non-use position. In the example of FIG. 4, an example holding arrangement is provided, and is shown holding the shower floor to a back of the shower. (An example back 21 of the shower is shown in FIG. 1 and FIG. 2). Thus it may be held, for example, behind the toilet, in the toilet mode. (An example is shown in FIG. 4, where the example holding arrangement comprises a clip(s) 23, which hold the shower floor in the non-use position. (However, as stated, the shower floor may stay in the non-use position merely due to gravity, if it extends beyond vertical in the non-use position. Thus a holding arrangement may not be required. (However, it is feasible it extends beyond vertical, and that there is also a holding arrangement)). (The example holding arrangement is shown comprising a plurality of clips, but may feasibly comprise only one). In other examples, the holding arrangement may comprise latch(es), and/or may be magnetic, etc, etc. Thus many different types of holding arrangements are possible, not limited to the examples shown and/or disclosed).

Preferably, in the shower use mode, a portion or a whole of the shower floor is sloped to facilitate drainage of water from the shower floor. An example of this is most clearly shown in FIG. 6, for example, (and also in FIG. 1), wherein the shower floor can clearly be seen angled downward, from front to back. (See FIG. 6, where the shower floor 14 clearly is angled downward from front (from the right side of the Figure) to back, (to the left side of the Figure). (Whilst most clearly shown in these Figures, this feature is provided in all of the embodiments of the Figures). In the example, a whole of the shower floor is angled. However, it is feasible just a portion (rather than a whole) is angled, to facilitate drainage. (It should be noted, it is stated 'a portion or a whole' of the shower floor may be sloped, because, whilst in the examples shown, a whole of the shower floor is angled (and is thus an example of a whole of the shower floor being sloped), it will be apparent that embodiments may be provided where not all of the shower floor is sloped, but rather a portion is sloped, to facilitate drainage of water from the shower floor. For example, (and simply to provide a basic example, provided by way of example only), it is feasible some of the shower floor is flat (and is not sloped), but that a part of the surface of the shower floor is sloped, for example, and that this facilitates drainage of water from the shower floor. Thus a portion or a whole of the shower floor may be sloped, to facilitate drainage of water from the shower floor.

(In the example(s) shown, the whole shower floor is angled. However, examples may be provided where the shower floor is horizontal/flat (eg on its underside), but is shaped in such a way (eg with a portion or a whole of its top surface being sloped, to facilitate drainage), to facilitate drainage. All such embodiments are within a scope of 'a portion or a whole of the shower floor being sloped', to facilitate drainage).

Preferably, water from the shower floor is directed, (in some way). (Feature(s) to facilitate this may be referred to as 'an arrangement to direct water from the shower floor'), (which itself may be referred to as a 'flow arrangement, to direct water from the shower floor')). Preferably water from the shower floor is directed into a water system of the toilet. (Thus preferably the combined shower and toilet arrangement comprises a flow arrangement, to direct water from the shower floor, into a water system of the toilet). (However, water from the shower floor is not limited to being directed into the water system of the toilet). Preferably, the flow arrangement is a flow arrangement to direct water from the shower floor, into a pan of the toilet. However, the flow arrangement may feasibly direct water from the shower floor into other area(s) of the water system of the toilet, (rather than, (or in combination to) the pan of the toilet). For example, it may feasibly direct water into a pipe(s), (eg a waste pipe(s)), of the water system of the toilet.

In a basic embodiment, the flow arrangement could, for example, be as simple as an aperture arrangement in the shower floor. For example, in the example embodiments, the toilet is shown comprising an example lid 38. (It should be noted, the/a toilet may, or may not, comprise a lid). If the pan of the toilet is open, (eg from the lid being open, or simply by virtue of the toilet not having a lid), then if there is an aperture arrangement in the shower floor, (eg a hole(s), for example), then water from the shower can drain through the aperture arrangement, and into the basin of the toilet. (The term 'aperture arrangement' here simply means 'one or more apertures'. For example, there could be more than one aperture (eg hole) in the shower floor, for water to drain through).

However, preferably the combined shower and toilet arrangement comprises a channel arrangement (ie one or more channel(s)), through which water from the shower is directed. (This is an example of a feature(s) that directs water from the shower floor). An example(s), (provided simply by way of example only), is shown most clearly in FIG. 5 and FIG. 6. In the example, the flow arrangement comprises one or more channel, (and thus comprises at least one channel 24). The or any channel may be fully enclosed. (An example of this would be a tube, for example, which is an embodiment of an enclosed channel). However, it is feasible the or any channel may be open. For example, channels, rather than being a tube, can be open at their top end, for example. Although an open channel of this type would not be a 'tube', it is nevertheless an embodiment of a channel.

(The example(s) of FIG. 5 and FIG. 6 clearly show an example of a channel arrangement, through which water from the shower is directed into the example pan of the toilet. However, in other examples, there may be provided a channel arrangement, through which water from the shower is directed, into any other part(s) of the water system of the toilet).

(Because, in the example embodiments in the drawings, the toilet is a flushable toilet, the flow arrangement, to direct water from the shower floor, into a water system of the toilet, is an example of a flow arrangement, to direct water from the shower floor, into a water flush system of the toilet).

Preferably, the combined shower and toilet arrangement comprises a catching area 26, to catch water from the shower. An example catching area is shown most clearly in FIG. 6. As shown in the example embodiments, preferably a portion or a whole of the catching area is provided behind (ie further back than) the shower floor, when the shower floor is in the shower use position. The or any catching area may come in the form of a gutter, for example, (and may thus comprise a gutter). (Again, a portion or a whole of the or any gutter may be located behind the shower floor). Preferably a portion or a whole of the shower floor is sloped so that water from the shower floor is directed towards the catching area. In other embodiments, the or any catching area may be provided in the form of a bowl element, for example.

(It is feasible there is provided a catching area, even if there is not provided a flow arrangement to direct water from the shower floor, into a water system of the toilet. For example, water from the shower could collect in a catching area, and the water and/or catching area could then be manually removed(/deposited) elsewhere, or pumped out, etc, etc) by a user, for example, (or via a mechanism(s) that may not require a user, for example). (It should also be stated that it is feasible that there is provided a catching area, without water being directed into the water system of the toilet, for example)).

Preferably there is then a channel arrangement, so that water is directed from the catching area, (if one is provided), to the toilet water system. (Thus preferably there is provided a channel arrangement, so that water is directed to the water system of the toilet, (whether or not there is a catching area). An example of this is clearly shown, (and shown best) in FIG. 5 and FIG. 6. In the example, the flow arrangement comprises a catching area, and also comprises a channel arrangement, to allow water to flow from the catching area. (In the example, the catching area is provided partially or wholly behind the shower floor, when the shower floor is in the shower use position, in the example, and, in the example, provided wholly behind the shower floor when the shower floor is in the shower use position). In the example, the channel arrangement directs water into the pan of the toilet. Thus, in the example, it enters the toilet water system. (As stated previously, it is possible the flow arrangement may feasibly direct water from the shower floor into other area(s) of the water system of the toilet, (rather than, (or in combination to) the pan of the toilet)). It will be known that many toilets have a water level system whereby (ie the system is designed such that) water cannot overflow from the pan (unless there is a blockage, for example). (In other words, the system is designed to prevent water from overflowing from the pan, as much as is possible). Thus water being directed from the shower floor, into the pan of the toilet, can be a very effective way of removing the water.

(It should be noted, the flow arrangement may feasibly comprise a channel arrangement, even without a catching area. For example, (provided by way of example only), it is feasible water from the shower floor goes straight into a channel arrangement (and into the water system of the toilet), (without first going into a catching area). Thus a channel arrangement can be provided as part of a flow arrangement, feasibly without a catching area)

There may be provided a support arrangement 28 for the shower floor, which, in the shower use mode, engages with a ground surface, to support the shower floor. Examples of this are shown most clearly in FIG. 1, FIG. 3, and FIG. 6. The support arrangement may be located in any position. However, preferably a portion or a whole of the support arrangement 28, when in use supporting the shower floor in the shower use mode, is in front of the receiving area 19 (and in front of the toilet pan, if the toilet comprises a pan). (Examples of this are best shown in FIGS. 1, 3 and 6).

Preferably, the support arrangement 28 comprises at least one step 30. (This is shown in several examples in the Figures, and is best shown in FIG. 3). In FIG. 3, the support arrangement comprises an X-frame, (shown by way of example only). It is known that such support structures can provide extremely effective (ie strong) support.

(In the example embodiment of FIG. 4, the example step(s) 30 is shown rotated up, with the shower floor in its non-use position).

Figure 3:
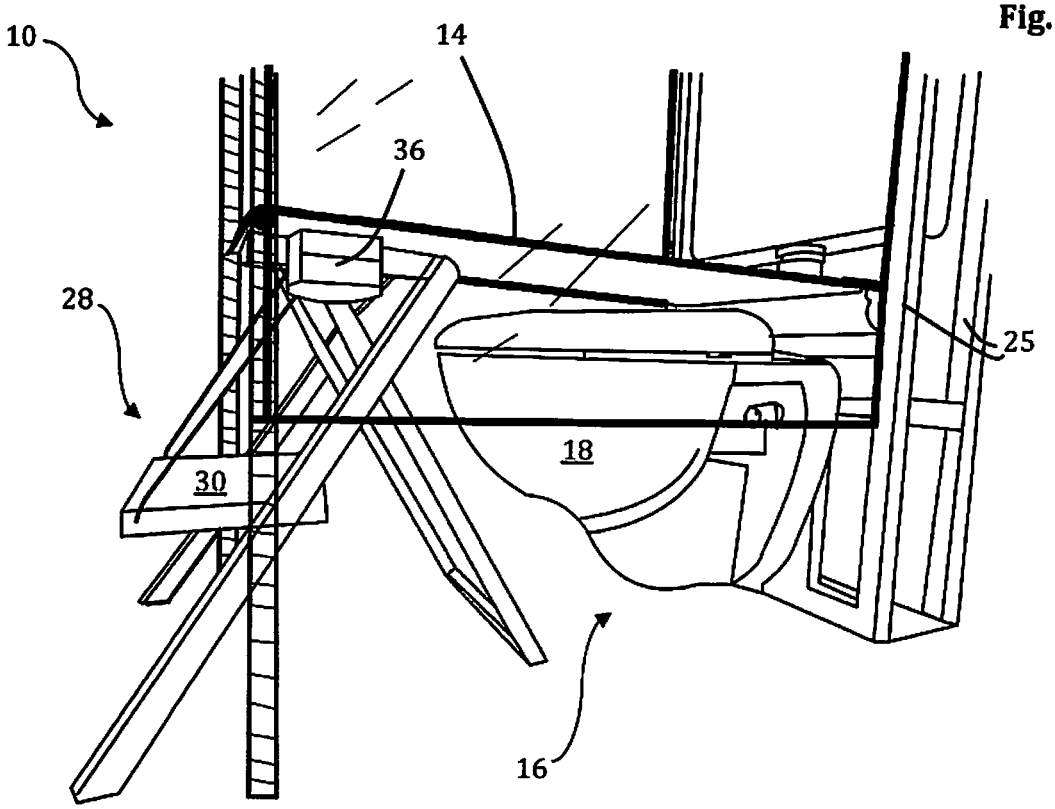
FIG. 3 is a side perspective view of an embodiment, from slightly below, showing an example of there being provided a support arrangement for the shower floor, which, in the example, comprises a step, to help a user get up to the shower floor.

(In FIG. 3, some parts of the shower (namely two example corner support structures) are shown transparented (with line shading to denote this), so that features of the example support arrangement can be seen more clearly. (It will be apparent that not all showers have corner support structures, and the example is shown by way of example only)).

The support arrangement is preferably connected to the shower floor. (This may be the case permanently. In other embodiments, it may be connected removably attachably). Preferably, the support arrangement is connected to the shower floor, and is at least one of: collapsible, (to save space in the toilet use mode); rotatable towards the shower floor, (to save space in the toilet use mode). Several examples of this are shown in the Figures. For example, in all the examples that comprise a support arrangement, the support arrangement is at least one of: collapsible, to save space in the toilet use mode; rotatable towards the shower floor, to save space in the toilet use mode. (It will be apparent that the example X-frame support arrangement of FIG. 3 is both collapsible, and also rotatable towards the shower floor. This saves space and makes it compact, in toilet use mode). An example of an embodiment of the support arrangement 28 rotated (and collapsed), to save space in the toilet use position, in shown in FIG. 4, for example.

Preferably, there is provided a toilet paper holder 32.

Preferably, there is provided a toilet paper holder 32, on an underside 34 of the shower floor 14. This is shown in many of the Figures. (In all the examples shown, there is shown a toilet roll 33 on an example toilet roll holder, (a toilet roll holder being an embodiment of a toilet paper holder)). As can be seen in FIG. 4, for example, the toilet roll holder thus allows for appropriate positioning (and providing) of a toilet roll, in the toilet use mode. (FIG. 1 shows an example of what position an example toilet roll may be in, in the shower user mode. As can be seen, in the example, the toilet roll is shielded from getting wet from any water from the shower).

Nate: Toilet paper is not limited to being provided as a roll, and therefore the toilet paper holder is not limited to being a toilet roll holder. For example, the toilet paper could be provided as stacked/layered flat sheets of toilet paper, for example. Thus the toilet paper holder could, for example, comprise/be a holder for holding such sheets. (eg The toilet paper holder could be a holder (eg substantially square or rectangular, for example, or any shape) that holds the sheets, and comprises an aperture, for example, through which one or more of the sheets can be pulled out of the holder, for example, for use). (This is just one example, provided by way of example only)). Thus the toilet paper holder is not limited to being a toilet roll holder. However, toilet roll is used throughout much of the world. Thus preferably the toilet paper holder is a toilet roll holder.

Preferably, there is provided a toilet flush user means 36, on an underside 34 of the shower floor 14. (This is best shown in FIG. 3 and FIG. 4, and is particularly well shown in FIG. 4). Whilst the toilet flush user means may feasibly be a mechanical user means, (such as a rotatable lever, for example, which initiates flushing), this may be fairly challenging to engineer, (taking into account the movement of the shower floor). Preferably, the toilet flush user means 36 is an electronic user means for flushing the toilet. (An example may be wherein the user means is a button (or any user means), for example, that the user can press, to activate the flush). Most preferably, the toilet flush user means 36 for flushing the toilet is a touchless user means. Touchless toilet flush user means are means that allow the user to flush the toilet, without touching the user means. They tend to work from a sensor(s), (which can sense the user's hand, for example, (or anything)). Thus a user can pass their hand, for example, in front of the user means, (to initiate flushing). In many cases, such touchless sensor flush mechanisms work by there being an electronic sensor(s), (which can sense the user's hand, for example, (or anything)). This can thus facilitate flushing, when the user's hand, for example, is in front of the touchless user means). Rather than, (or in combination with), flushing being activated by a user's hand, for example, (or anything), being 'in front of' the user means to activate flushing, flushing may be activated by proximity of the user's hand, for example, (or anything), to the user means, to activate flushing. Thus various possibilities/options are possible. (The examples provided are provided by way of example only. Such touchless sensor flush mechanisms often then comprise a wireless receiver. (Such mechanisms are not limited to being wireless, and may function via (and thus comprise) wiring, rather than being wireless). The receiver having received a signal(s), the touchless sensor flush mechanisms often is configured to activate a mechanism to pull/manipulate a chain (or other mechanism), which itself causes/initiates flushing. The example embodiments of the drawings, for example, (provided by way of example only), comprise such (or similar) feature(s), to facilitate touchless flushing. (It will be apparent that many different ways of facilitating touchless flushing (via a touchless user means) may be provided, and the examples are provided by way of example only).

(It should be noted, examples are given wherein the/a flush user means is on an underside of the shower floor. However, these are provided by way of example only, and the or any flush user means may be provided anywhere, at any location. For example, it could feasibly be provided above (higher than) the shower floor (when the shower floor is in the non-use position, or to the side, or anywhere)

(Relating to use of the term 'electronic' in the present application, the term is used to broadly mean 'in any way involving electronics'—eg a device which in any way uses electronics, to fulfil its end, is deemed an 'electronic device').

Preferably, the shower can be enclosed on all sides. For example, some showers have a wall on one or more sides, for example, and then are enclosed on the other sides, (eg via a 'screen(s)', which may or may not be a door, or any type of 'side' of the shower, (often made partially or wholly of glass, or any other suitable material(s)). There may, for example, be a wall on two sides of the shower, a screen on another side, and a door completing the enclosing arrangement, in some embodiments. Thus, in such an example, the wall(s), screen, and door together form an enclosing arrangement, (for the user to shower in). (It is even feasible that a whole enclosing arrangement (which may be an enclosing cubicle arrangement) is provided byway of screen(s), (with one of the screens potentially acting as (and therefore being) a door). The shower (and enclosing arrangement) will tend to be cubic in shape (as most showers are). However, whilst unusual and/or unlikely, it is even feasible an enclosing arrangement could even be circular (or any shape). For example, a screen, (for example), could circumnavigate most or a whole of the shower, (and therefore could be provided a door, to complete a circular enclosing arrangement). (This, however, would be unusual, usually showers (and enclosing arrangements of showers) tend to be cubic in shape, and are often substantially square in shape). In other embodiments of showers, there may be three walls, for example—eg a back wall, and a wall on a left and a right side. In such cases, there may then be a front shower door, (often made partially or wholly of glass), (or even a curtain). Thus this is another embodiment wherein the shower can be enclosed on all sides. (Many and any type/configuration of enclosing arrangement is possible).

(In all the example(s) shown in the Figures, the shower can be enclosed on all sides. However, in some of the Figures, the side(s), front, etc are not shown (eg FIG. 5), so that other features can be shown in greater clarity. However, as stated, preferably the shower can be enclosed on all sides. (It should be noted, the term 'the shower can be enclosed on all sides' does not refer to the top and bottom of the shower. For example, in the example of FIG. 1, the shower is not enclosed at the top, but is nonetheless an example of wherein 'the shower can be enclosed on all sides'. The shower may or may not be enclosed at the top)).

(In the example(s) shown, the enclosing arrangement is a cubicle enclosing arrangement. However, to avoid any limitation that may be read on to the term 'cubicle', (eg which may suggest the shower has to be cubic in shape), the term 'enclosing arrangement' is used, (without the term 'cubicle'). (As mentioned, the shower (and the combined shower and toilet arrangement) is not limited to being cubic in shape)).

It should be noted, it is technically feasible that embodiments may be provided wherein the shower can be enclosed on all sides, but the combined shower and toilet arrangement, as a whole, cannot be. For example, an embodiment may be provided, (similar to FIG. 1, for example), wherein the combined shower and toilet arrangement comprises an external shell (or, to use a broad term, an 'outer body'), which itself may go around, for example, what is seen in FIG. 1 (or any relevant embodiment/features). In such an example, it may be that the outer body can be enclosed on all sides, or it is feasible, possibly, that the outer body cannot be enclosed on all sides (eg if it has an open front (or any open side(s)), for example, which cannot be closed). In such an example, (where the outer body cannot be enclosed on all sides, (but where the shower, for example, can be enclosed on all sides)), it would be an example of wherein the shower can be enclosed on all sides, but wherein the combined shower and toilet arrangement, as a whole, cannot be enclosed on all sides. Thus it is stated that preferably the shower can be enclosed on all sides. (And preferably it is also true, if the shower can be enclosed on all sides, that, even if the combined shower and toilet arrangement comprises an outer body, that the outer body (and thus the combined shower and toilet arrangement) can be enclosed on all sides). In the example of FIG. 1, the shower is clearly able to be enclosed on all sides (once the door is closed, in the example).

As stated, preferably, the shower (and preferably the combined shower and toilet arrangement) can be enclosed on all sides. In the same way as above, many and any enclosing arrangement may be possible/provided. (For example, enclosing arrangement may comprise a combination of wall(s) and shower screen(s), for example). FIGS. 1, 2 and 4 especially, (albeit often in partially cross-section views), denote/show example enclosing arrangements. One of the benefits of having an enclosing arrangement is that it helps contain water in the shower, in use. In the examples of FIGS. 1, 2 and 4, example door(s) are shown, (shown by way of example only). (It will be apparent that many different types/designs of doors may be provided, for example). In the example, there are two doors parts 40, which together form the example door. (The or any door may comprise only one door part, or may comprise a plurality of door parts). In the example(s), there is provided a handle(s) 44, to open the door. Thus, in the example the combined shower and toilet arrangement comprises a door(s), and a handle(s) to open the door(s). In the example, the combined shower and toilet arrangement comprises hinge(s) for the door(s). (Example hinge(s) 42 are shown in various Figures, by way of example).

In the examples, the shower floor 14 is seen attached as part of the combined shower and toilet arrangement 10. (In the example, it is attached via hinge(s). However, in other embodiments, it may be attached in other ways). (It is feasible the shower floor is removably attachable in such a way that makes it more instantly and/or easily attachable (than via hinge(s), for example)).

Figure 7:
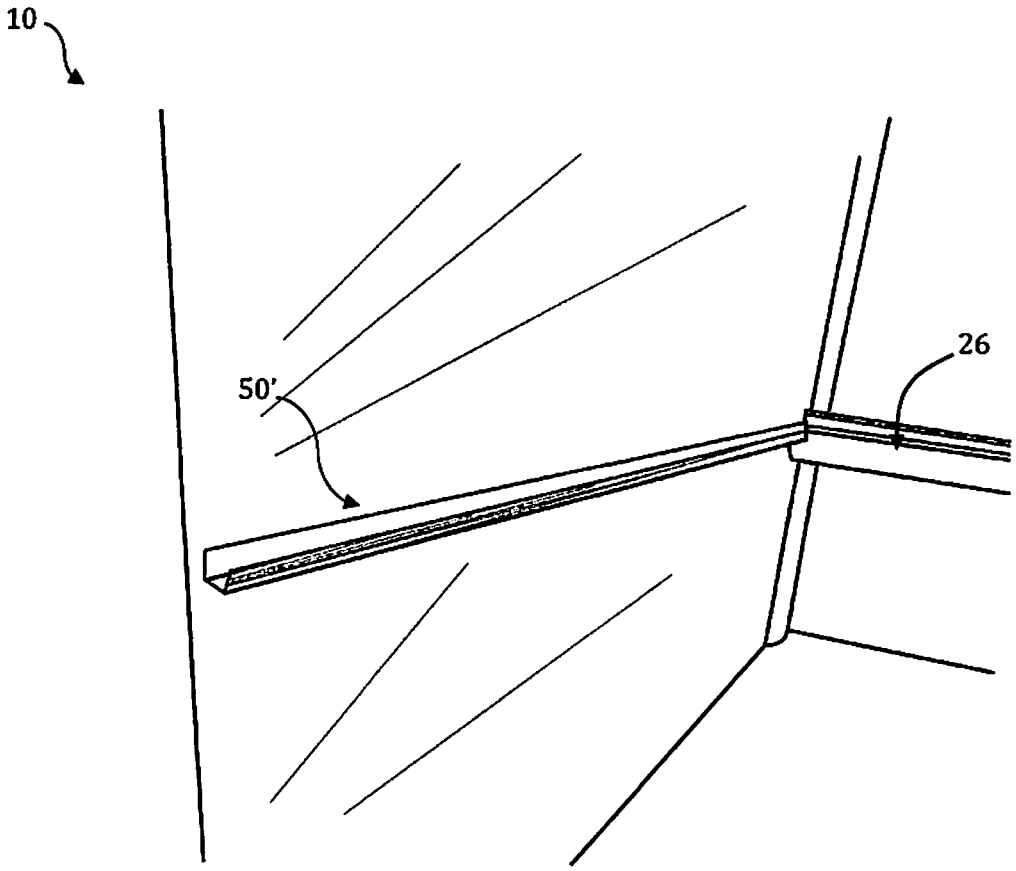
FIG. 7 is an example of a portion or a whole of a securing arrangement to hold the shower floor in a shower use position, (showing only one side of the combined shower and toilet arrangement)
Figure 8:
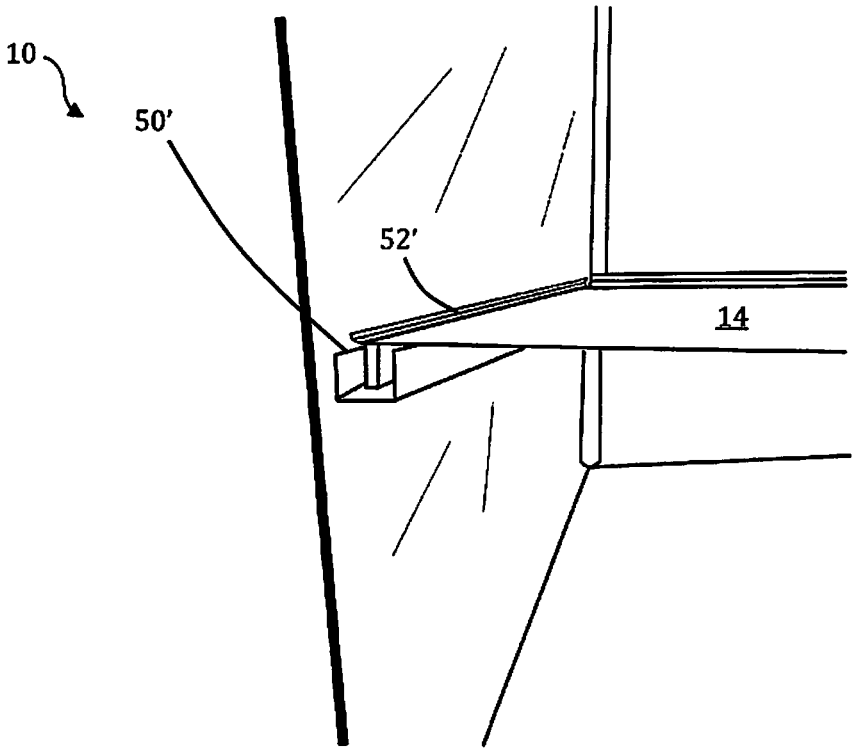
FIG. 8 shows the shower floor being held in the shower use position, by the example said securing arrangement, (again showing only one side of the combined shower and toilet arrangement)
Figure 9:
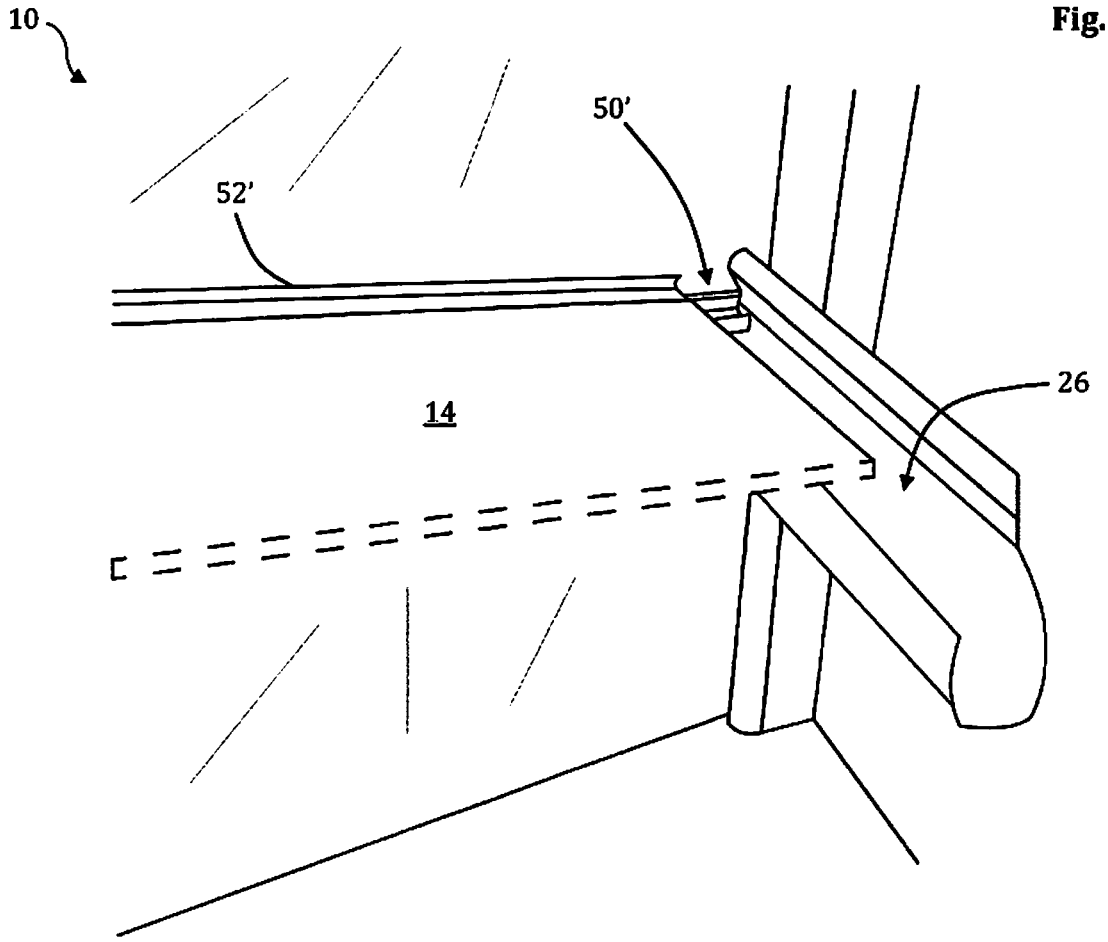
FIG. 9 is a perspective view of a back corner of the example shown in FIG. 7 and FIG. 8, showing an example of the shower floor being angled downwards, towards an example catching area, which, in the example, is at a back of the combined shower and toilet arrangement.

Referring to FIGS. 7 to 9, there is shown an example embodiment of wherein, in the shower use mode, the shower floor is water-tight to a portion or a whole of a perimeter of the shower. (Whilst these feature(s) are not explicitly shown in the embodiment(s) of FIGS. 1 to 6, in the embodiment(s) of FIGS. 1 to 6, the shower floor is preferably water-tight to a portion or a whole of the perimeter of the shower, in the shower use mode.

This may be achieved in many ways. For example, the shower floor could comprise a protruding portion(s), and the perimeter of the shower (which is the perimeter of the enclosing arrangement, in the example(s) shown, (the example enclosing arrangement being an enclosing cubicle arrangement in the example) could comprise a recess(es) to receive the protruding portion(s) of the shower floor, (or vice versa, with the perimeter of the shower comprising a protruding portion(s), and the shower floor comprising a recess(es) to receive the protruding portion(s) of the perimeter). The protruding portion(s) and recess(es) may connect together in a way that is water-tight. (This may, for example, include a portion or a whole of the protruding portion(s) and/or recess(es) being deformable. An example of deformability would be, for example, being made of rubber, (or any other deformable material(s)). In the example embodiment of FIG. 7, there is shown part of a stopping arrangement, to stop the shower floor. There is shown an example stopping feature SO', (which is part of the stopping arrangement, to stop the shower floor). (It can be seen, in FIG. 8 and FIG. 9, how the stopping arrangement is holding the shower floor in position, in the shower use mode). (In the example, the example stopping feature SO' is provided by way of (and the example stopping arrangement therefore comprises) a bracket feature(s)). In other examples, for example, the shower may simply comprise a protruding portion(s) that stops the shower floor in position, in the shower use mode. (Stopping arrangements of varying type, shape and design may be provided, not limited to the example(s) shown).

In the example, the stopping feature (and/or stopping arrangement) is angled (and is sloping). In the example, fluid (and thus water from the shower) can drain down the stopping feature).

In the example, the stopping feature is angled slightly downward, toward an example catching area 26. In the example, the catching area is provided by way of (and therefore comprises) a gutter. (The stopping arrangement being sloping may lead to water draining from the shower floor, (preferably into a catching area). (As previously stated, the or any flow arrangement may feasibly comprise a channel arrangement, even without a catching area. Thus, other embodiments may be provided, for example, where the stopping feature is angled slightly downward, toward a flow arrangement, (whether there is a catching area or not).

In FIG. 8, the example shower floor 14 is shown held in position, (in the shower use mode), by the example stopping arrangement. In the example, a portion of the shower floor has descended into the example bracket element. (However, this is just one example of how a stopping feature may stop the shower floor, and many other embodiments of how this is done may be provided, not limited to the example of FIG. 8). In FIG. 8, therefore, water from the shower that falls onto the shower floor, (due to slope of the stopping arrangement and thus slope of the shower floor, in the example), flows toward (and into) the example catching area 26. (However, it will be apparent that it is not required that the (or any) stopping arrangement is sloped/angled, to achieve this—for example, the stopping arrangement could be horizontal (or any angle), and the shower floor could simply then have a portion or a whole of a surface that is sloped, so that water flows from the shower floor, to the example catching area).

In FIG. 9, the same (or a similar) embodiment is shown, as to that shown in FIG. 7 and FIG. 8. The shower floor is shown/illustrated cut off (denoted by the dashed lines in FIG. 9), so that the example catching area 26 can be seen better. It can be seen how, in the example, water would be able to flow off the shower floor 14, and into the example catching area 26.

It has been stated that, in the shower use mode, the shower floor is preferably watertight to a portion or a whole of the perimeter of the shower. As stated, this may be achieved in many ways. In the example(s) shown in FIG. 7 to FIG. 9 (and shown clearly in FIG. 8 and FIG. 9), this is achieved by way of a seal arrangement. In FIG. 8 and FIG. 9, an example seal element 52' is shown. In the example, a portion or a whole of the seal element is deformable. Thus it (the portion or a whole) may, for example, be made of rubber, for example, and/or plastic, and/or any deformable material(s). It will be apparent then, in the example, by way of the seal element 52' engaging with a side(s) of the example shower (and enclosing arrangement) in the example, it is able to provide a watertight seal. (In the example, this allows all of the water to be directed towards the example catching area 26).

(Note: it is feasible that, (rather than in the example of FIG. 8, for example, where 'water-tightness' is achieved right at the very edge of the perimeter of the shower), that water-tightness is achieved distant from the edge of the perimeter of the shower. For example, embodiments may be provided, for example, where a feature(s) (eg a ledge, for example) extends/protrudes from the side of the shower. The shower floor, in the shower use mode, may then engage with this 'ledge', and may do so, for example, in a way that achieves water-tightness with this ledge (in the example), distant (ie away from) the edge of the perimeter, (ie further in to the shower than in the example of FIG. 8). This, for the sake of the present application, is still considered to be an example of the shower floor being watertight to a portion or a whole of a perimeter of the shower. However, to make sure no undue/unintended limitation is read onto the term 'perimeter', it is therefore broadly stated that, preferably, in the shower use mode, the shower floor is watertight to a portion or a whole of a 'side' of the shower. (This includes within its scope either of the examples given—ie wherein water-tightness is achieved right at the edge of the shower, or even if it is achieved (eg via a 'ledge', as in the example given) further inwards). (It should also be stated that, whilst the cubic shape of the examples in the drawings makes it clear that the example showers have a front side, a back side, a left side and a right side, it is feasible showers of various shapes may be provided, (not limited to the examples shown). Nevertheless, they are all considered to have a 'side'; for example, a circular shower may be provided. In such a case, even though a 'front', 'back', 'left' and 'right' side may not be so clear to distinguish, nevertheless, the circular shape forms a 'side' of the shower. (And due to other features of the shower, it may be clear what is the 'back', 'front', 'left' and 'right' of the shower). Thus even for a circular (or any shape) shower, nevertheless, preferably, in the shower use mode, the shower floor is watertight to a portion or a whole of a side of the shower). (Thus the term 'water-tight to a portion or a whole of a side of the shower' is considered to include within its scope the term 'water-tight to a portion or a whole of a perimeter of the shower').

Figure 10:
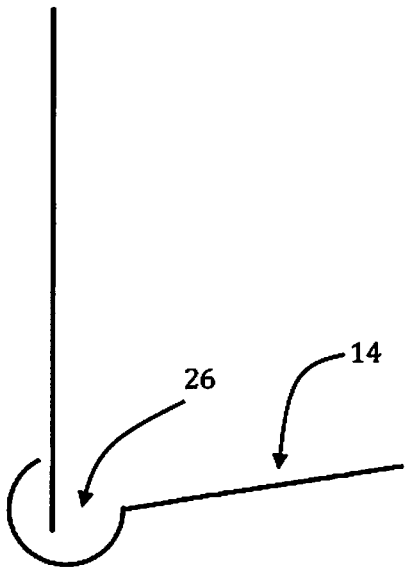
FIG. 10 is a basic representational side view, showing how a catching area for catching fluid from the shower floor may come formed as a same part as, (or attached permanently or removably attachably to) the shower floor.

In FIG. 10, a basic view is shown, to denote that it is feasible the or any catching area may be provided, as part of the shower floor 14. In the example, the shower floor can rotate upwards (towards, for example, back wall/side 21, which is what the upward line in the drawing may, or may not, represent). Similarly, the shower floor can rotate to the shower use position that it is shown in in FIG. 10. The example catching area 26 is shown. Thus this is an example of an arrangement which allows for the catching area to be provided as part of the shower floor, (ie for them to be provided as part of the same structure/piece). In such an embodiment, the catching area may be permanently attached to the shower floor, may be removably attachable, or may be formed as one piece with a portion or a whole of the shower floor.

It will be apparent that, in FIGS. 7, 8 and 9, only one side of the example combined shower and toilet arrangement 10 is shown. However, it will be apparent that preferably similar (or the same) features are provided for the other side of the example combined shower and toilet arrangement 10. Thus a stopping feature may also be provided on the other side, (as part of the/a stopping arrangement). Thus there may also be a seal element on the other side. In the example, the shower floor does comprise another seal element on the other side, (not shown in the Figure).

It should also be stated, such feature(s) may also be provided at a front side of the shower and toilet arrangement 10. For example, if there is a door, then the shower floor may also be watertight to a portion or a whole of the door. (As stated, and made clear, this may be achieved in many ways, including, but not limited to, the example feature(s) as shown in FIGS. 7 to 9). Thus the door may, for example, comprise a stopping feature, to stop the shower floor, in the shower use mode.

Similarly, the watertight arrangement may mean the combined shower and toilet arrangement is watertight between the shower floor and the door, in the shower use mode.

(It should also be stated that all feature(s) previously disclosed with reference to achieving watertightness, (eg the shower floor comprising protruding portion(s), and the perimeter of the shower comprising a recess(es) to receive the protruding portion(s) of the shower floor, (or vice versa, with the perimeter of the shower comprising a protruding portion(s), and the shower floor comprising a recess(es) to receive the protruding portion(s) of the perimeter) may be provided/afforded, with reference to the door and the shower floor. Disclosure relating to include a portion or a whole of the protruding portion(s) and/or recess(es) being deformable may also be afforded, with reference to the door and the shower floor).

Whilst the example stopping arrangement is shown comprising separate (more than one) stopping features, it is feasible just one stopping feature is provided, which nevertheless stops the shower floor, in the shower use mode. In such a case, the one stopping feature may, feasibly, circumnavigate a whole of the perimeter of the shower. (However, it will be apparent that embodiments may be provided where (whether there is on, or more, stopping features) the stopping arrangement does not go around the whole of the perimeter, and yet is able to carry out its function, to stop the shower floor).

In summary, then, when in shower use mode, it may be preferable that there is a water-tight barrier to prevent escape of water. Thus, for example, the or any side (or any portion at all) of the shower may be flush to the shower floor 14, in shower use mode, in order to assure watertightness. (In some embodiments, the or any side of the shower may be provided by way of side panel(s), (which may be made of glass, for example)). (As stated, to create 'watertightness' and/or 'flushness', feature(s) may be provided to/with the shower floor (and/or even the or any side(s) of the shower), (eg as shown in FIG. 8, for example).

(Note: It has been said that there is shown a 'stopping arrangement' in FIGS. 7 to 9. In the example, if the arrangement stops the shower floor, (and supports the shower floor (and anyone standing on the shower floor, in use)), then it is an example of a support arrangement, to support the shower floor (in the shower use mode).

Nate: It could be argued (and may well be the case) in some embodiments that an example support arrangement (such as the example of FIG. 8, for example), whilst not 'engaging with the ground surface' in such an obvious (or 'direct') way as the example of FIG. 1, for example, could be argued to (and may well) 'indirectly' engage the ground surface, by virtue of being connected to another feature(s) of the combined shower and toilet arrangement, (such as a side(s) of the shower, for example, which itself engages with the ground surface, or a further support feature(s) (such as a corner strut(s)/feature(s), for example, which itself engages with the ground surface). This may therefore be considered an example of the/a support arrangement 'indirectly' engaging the ground surface, (such as the example arrangement of FIG. 8, for example). (Other examples may include, for example, slide-out/pull-out (or in any way movable) feature(s), (eg slide-out panel(s)), which may be usable to support the shower floor, (and may, or may not, indirectly engage the ground surface). However, it will be apparent that, in the example of FIG. 1, for example, (and perhaps better shown in the example of FIG. 3), the support arrangement (which comprises a step(s), in the example), engages with the ground surface 'directly'. (Therefore, broadly put, preferably, the or any support arrangement engages with the ground surface, directly or indirectly. (It is feasible, although unlikely, that a support arrangement could in no way (either directly or indirectly) engage with the ground surface. (Eg it could engage with the/a ceiling, for example, rather than the ground surface, (although this may be cumbersome and undesirable, from a build and/or function point of view).

(Furthermore, the example of FIG. 1 (and FIG. 3, for example), is an example of wherein there is a support arrangement that, in the non-use mode (of the shower floor), does not engage the ground surface, and, in the shower user mode, does engage with the ground surface (to support the shower floor). (Thus, preferably, there is provided a support arrangement to support the shower floor in the shower use mode, wherein, the support arrangement, in the shower use mode, engages with a ground surface, to support the shower floor; and in the non-use mode, does not engage with the ground surface).

Preferably, in such embodiments, such support arrangements are connected to the shower floor. Preferably they are connected to the shower floor, and move with the shower floor, as the shower floor moves from the shower use mode to the non-use mode (and vice versa). (An example(s) of this is shown in many of the Figures). (However, such support arrangements (ie that, in the shower use mode, engage with a ground surface, to support the shower floor; and in the non-use mode, do not engage with the ground surface) may not be (ie may not be connected to the shower floor), and may, for example, be placed/positioned anywhere (eg hung up somewhere, for example), in the non-use mode, before then being used as to support the shower floor (and engaging with the ground surface) in the shower use mode). Furthermore, it should be stated there may be examples of support arrangements that engage with the ground surface (both in the non-use mode, and in the shower use mode), and which are not connected to the shower floor. For example, an example would be a support arrangement (eg support strut(s) or the like), which is permanently connected/attached to the ground surface, (and not connected to the shower floor (at least not in the shower use mode, and preferably not connected to the shower floor in the non-use mode and the shower use mode)). Thus a protruding strut(s), for example, may extend from the ground surface, and be usable to support the shower floor in the shower use mode. It may then simply remain in the same position in the non-use mode, (or may, for example, be in some way movable (whilst remaining connected/attached to the ground surface), in the non-use mode). Thus various different support arrangement embodiments are possible).

The example shown in FIG. 8, therefore (if what is shown is an example of a support arrangement), is not an example of a support arrangement which, in the shower use mode, 'directly' engages with a ground surface, to support the shower floor, (because those features do not, in the example, engage with a ground surface (eg a bathroom floor). It should also be stated that such features may be provided, along with a support arrangement for the shower floor, which, in the shower use mode, engages with a ground surface (directly), to support the shower floor. (Thus the example stopping arrangement shown in FIGS. 7 to 9 may, for example, be provided with a support arrangement for the shower floor, which, in the shower use mode, engages (directly) with a ground surface, to support the shower floor, (such as the example support arrangement 28, for example, of the embodiment of FIG. 1, which, in the shower use mode, engages directly with a ground surface, to support the shower floor). It should also be stated that, rather than the example stopping arrangement of FIGS. 7 to 9 being a stopping arrangement, it is feasible that such an arrangement (and any such feature(s)) are provided, but where the shower floor is not stopped by the arrangement, (it therefore not being a stopping arrangement), and the shower floor is then supported by other feature(s), (such as the example support arrangement 28 of the example of FIG. 1, for example, or any other arrangement(s), (eg cantilever/limited rotation, or any support arrangement(s) at all, eg slide-out/pull-out feature(s), etc, or any other support arrangement(s), for example). (The or any support arrangement could be provided anywhere in any way (eg jutting out element(s) (which would be an example of a protruding element(s)) from side (or any area) of the shower. Thus a huge array of possible embodiments are possible). Thus the shower floor, in such embodiments, could feasibly 'hover' (ie 'be') above the arrangement (eg above the example arrangement shown in FIGS. 7 to 9). Thus, in such an example, the arrangement shown in FIGS. 7 to 9 would not be a stopping arrangement. However, it still may provide any of the other benefits disclosed with relation to it, (eg facilitating flow of fluid, and/or facilitating water-tightness, etc). (As stated many times, the example(s) are provided by way of example only). (It could, in embodiment(s) where it is not supporting the shower floor, act as a 'fall-back', wherein, if the other support feature(s) fail, it is able to support the shower floor).

(Nate, cantilever (or any limited rotation mechanism) may be provided, and may be a means for the shower floor to be 'supported' or 'stopped' in the shower use position. However, such mechanisms may be likely to 'fail' if not used in conjunction with other support feature(s). Therefore, preferably, if a cantilever (or any limited rotation mechanism) is used, a support arrangement(s), (to support the shower floor in the shower use mode) is also provided.

The combined shower and toilet arrangement may be removable/transportable as a unit. For example, it is feasible that all (any or all of the features) that is shown in the example of FIG. 1 is transportable (whether all kept together as shown, or feasibly with parts being removably attachable (and/or disassemble-able) from each other), so that it could be placed, for example, in another location. Whilst it is feasible the combined shower and toilet arrangement can be provided built-in as part of a room/location (eg with any or all of the sides of the combined shower and toilet arrangement being provided by wall(s) of a room, for example), it is feasible (and in fact may be preferable) that all parts (eg in the example of FIG. 1) are provided as a unit. Thus it may be possible to add the combined shower and toilet arrangement to any location and/or room that it can fit into. (It is feasible, in a situation where water plumbing and/or feature (s) are already present, that the other features of the combined shower and toilet arrangement can be 'added' to the water system feature(s) already present. This may be useful, for providing the combined shower and toilet arrangement to bathrooms that already have water plumbing/evacuation in place). It may be possible, (as stated), to disassemble a part or parts of the combined shower and toilet arrangement. This may allow for it to be easily taken to a location for it to be provided in, (eg easy to take it through a door of a bathroom, (or any room), in parts), and then build it, in that location. As stated, it also may allow for the combined shower and toilet arrangement to be re-located to another location. It may, or may not, come with a floor 101. It may, or may not, come with a back wall 20.

Thus the combined shower and toilet arrangement may be transportable, (whether that be as an assembled unit, or as disassembled parts), (and may comprise an enclosing arrangement that is transportable as part of the combined shower and toilet arrangement).

(Thus, broadly put, it is feasible that the combined shower and toilet arrangement may be transportable, assembled together).

Thus, broadly put, a portion or a whole of the combined shower and toilet arrangement may be transportable (as a unit), assembled together. It is feasible, in some embodiments that a whole of the combined shower and toilet arrangement is transportable (as a unit), assembled together. Such a unit could be, for example, used for festivals, etc (or any other use). Thus the unit may be transported (eg by lorry, or any other way/means), used for a festival, for example, and then removed (and transported elsewhere, for example), potentially for use at another festival and/or event and/or place.

Figure 11:
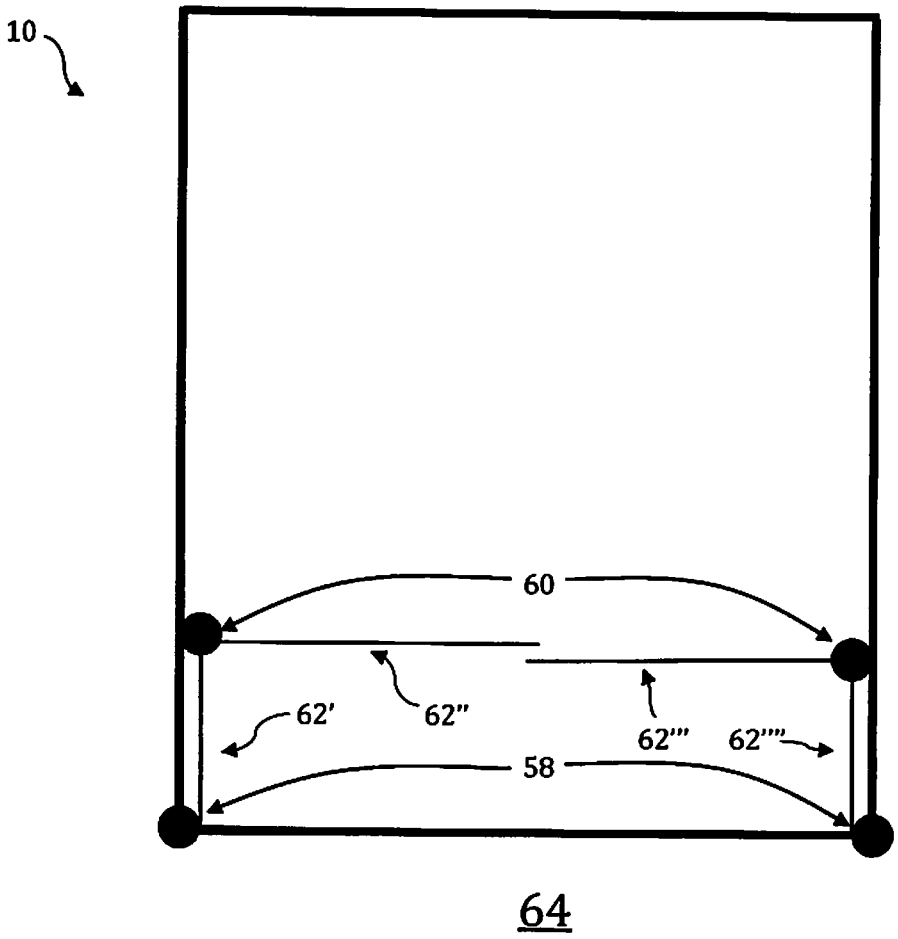
FIG. 11 shows an example wherein a door of the combined shower and toilet arrangement is advanced, which may help prevent water from escaping from the combined shower and toilet arrangement.

It is possible the door may be advanced, compared to where the sides of the combined shower and toilet arrangement end. An example of this is shown in FIG. 11, by way of example. (Features such as the toilet, the shower fluid outputting arrangement, etc are not shown in FIG. 11, in order to focus clearly on the example door features shown). In the example, there is shown a first pair of hinges 58, and a second pair of hinges 60. In the example, the door comprises portions 62. In this example, portions 62" and 62''' are therefore, when the door is in a closed position, advanced, compared to where the sides of the combined shower and toilet arrangement end. (In the example, the sides of the combined shower and toilet arrangement end generally around where hinges 58 are). If the shower floor 14 is angled, for example, to drain fluid to a back of the shower (eg into a catching area), then the advanced door, should guarantee that no water from the shower escapes from the shower generally into space/area 64, for example. Since this area may be a floor of a bathroom, for example, this is helpful in keeping the floor of the bathroom dry. In the example, there are hinges 60 at a side of the door, but in other examples, the door may be advanced and may sit flush to the sides of the shower (rather than there being hinge(s) in this location). This is just one example of how a door may be advanced beyond where the sides of the shower end, in no way limiting such a concept. For example, the door may be advanced without there being any hinge(s). A door may be advanced without having multiple different portions. The example is provided by way of example only.

Nate: it is, of course, (just like for ordinary showers), possible that a curtain maybe provided, (eg with a rail, et al., or ay way of proving a curtain), which could function, (and be provided) similarly to a door, (or at least to prevent water from escaping and/or provide privacy). The or any curtain may be afforded any feature(s) afforded to the or any door in the present application—eg it may be 'advanced', compared to where the sides of the combined shower and toilet arrangement end. (As stated, (and shown in an example embodiment of FIG. 11, for example), this may help water not escape from the shower, in use). It may, of course, be even easier for a curtain to be provided in an advanced position (or any position); for example, a curtain rail may be provided in an advanced position, allowing the curtain to be opened and closed, when needed, in an advanced position. (A curtain rail may be provided in any position, of course). It should be stated, if the shower is enclosed on all other sides, and a curtain (which may of course be of soft material(s), of course), allows the shower to therefore be enclosed on all sides, then, in such an example, a curtain allows for the shower to be enclosed on all sides. (Such an example would then be an example of an 'enclosing arrangement' (comprising a curtain)). Thus, embodiments may be provided where the shower can be enclosed on all sides, via use (at least on one side) of a curtain. (Of course, it is feasible a curtain could be used to enclose the shower on more than one (or even all) sides. For example, many shower curtains go around a corner of the shower, and enclose the shower on two sides. (And it is feasible a curtain could even be used to enclose the shower on all sides)). (It should also be stated, whilst unlikely, it is feasible there could be provided both a door, and curtain). (However, as made clear in the example(s) in the Figures, preferably the combined shower and toilet arrangement comprises a door, to facilitate enclosing the shower on all sides).

(It should be stated, it is feasible embodiments may be provided where there is not an enclosing arrangement. Thus the combined shower and toilet arrangement could, feasibly, be provided in quite an 'open' way, (without being enclose-able on all sides). However, it may be extremely beneficial (especially for retaining water during shower use and/or for not making a mess with water from the shower) for there to be an enclosing arrangement on one or more sides. There is preferably provided a door, to complete the enclosing arrangement, so that the toilet and shower arrangement is enclosed on all sides, (when required/desired)).

In the example of FIG. 5, for example, there is shown an example structure 25. (The example could be described as a 'chassis'). The example structure is provided by way of example only. (Various different designs/shapes may be provided). In the example, the structure comprises one or more (and in the example comprises a plurality) of upward struts. The example is shown working as a frame. In the example, the structure supports one or more feature(s) of the combined shower and toilet arrangement. In the example of FIG. 5, the structure supports any of (and in the example supports all of): the toilet; an example unit 27 (which preferably comprises a tank), (broadly speaking, a portion or a whole of the or any flushing system); the shower floor; a catching area 26. (And may support any other feature(s)). Thus it may support any feature, or combination of features. (It should be noted, the example of FIG. 5 is an example of a suspended toilet. (If the toilet is not suspended (eg as in FIG. 6, for example), there may or may not be provided a structure 25)).

(The example structure is provided by way of example only, and may different types of composition and/or shape, etc may be provided. In the example, the example structure 25 comprises a plurality of struts (vertical and horizontal). However, this is provided by way of example only).

(In the example, unit 27 comprises a tank. (In the example, the tank is a cistern). (The tank, in the example, stores water).

(It will be apparent that the combined shower and toilet arrangement could be provided, if a toilet is already present (eg in a bathroom), by adding the shower, and any of the feature(s) disclosed in the present application. Modification may be undertaken, (if so desired), in some cases (and/or for some feature(s)), (eg to create a channel 24)).

Similarly, it is feasible (although likely more complex and/or more of an undertaking) to provide the toilet (and perhaps any other relevant and/or desired feature(s)) to a shower which is already present (eg in a bathroom).

Thus the combined shower and toilet arrangement can be provided, by way of 'addition', to a pre-existing toilet or shower. However, preferably, the toilet and the shower are constructed/fitted together (as part of the same build), (rather than adding one or the other to a pre-existing toilet or shower).

In the example of FIG. 1, any or all of the features provided may be provided as a unit, (rather than features like the example wall 20 and example floor 101 being part of the or a room the combined shower and toilet arrangement is provided for/in). Thus the example floor 101 (in FIG. 1, for example) may be the floor of a room (eg preferably a bathroom), or may actually be a feature provided (which can be used on a ground/floor, (feasibly even outdoors and not limited to indoors, eg in a bathroom) as part of the combined shower and toilet arrangement. The unit may transportable. The unit may feasibly be provided as an assembly. Thus one or more parts may be de-assembled, for transportation. The combined shower and toilet arrangement, (preferably provided as a unit), may be provided for festivals (eg outdoor festivals). In such a case, the combined shower and toilet arrangement is preferably enclosed on all sides. (This may be useful/important for privacy, and/or temperature, etc).

Thus, broadly put, (for any embodiment), any or all of the features may be provided as part of an assembly.

Thus, broadly put, (for any embodiment), any or all of the features may be provided as part of a unit, (which may be transportable).

Preferably, in the shower use mode, a portion or a whole of the shower floor is sloped, to facilitate directing water from the shower floor, and wherein, due to the portion or the whole of the shower floor being sloped, water from the shower floor is directed at least one of: off a side of the shower floor; through an aperture arrangement in the shower floor, wherein the aperture arrangement is not positioned above the receiving area of the toilet.

Preferably, due to a portion or a whole of the shower floor being sloped, water from the shower floor is directed off a side of the shower floor. (An example of this is shown well in FIG. 6, for example, where water is directed off a side of the shower floor. In the example, water is directed off a back side of the shower floor, but in other embodiments, for example, water may be directed off any side(s) of the shower floor, due to a portion or a whole of the shower floor being sloped).

Figure 12:
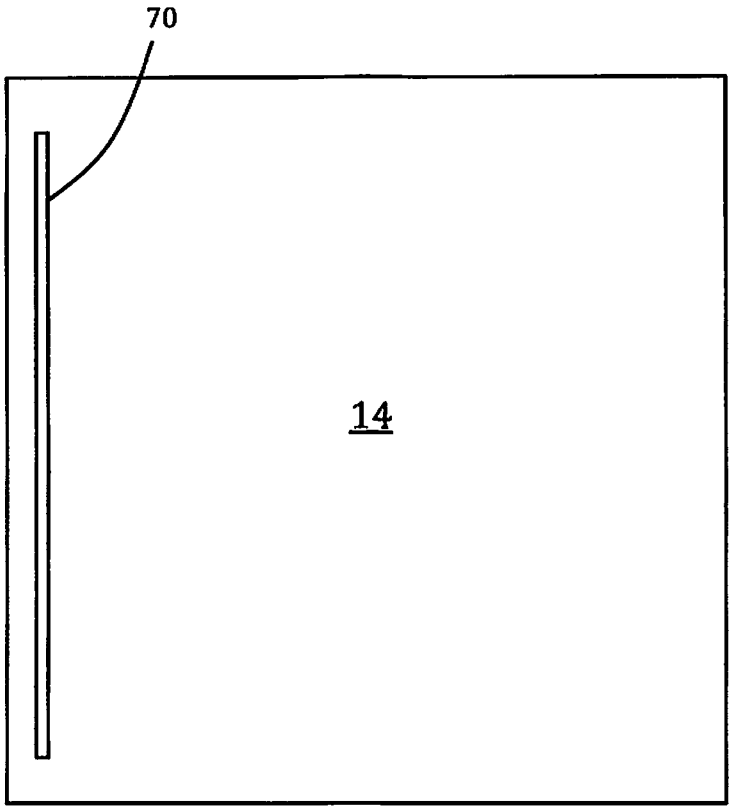
FIG. 12 is a view, from above, of an example shower floor, showing an example aperture arrangement in the floor that is not positioned above the receiving area of the toilet.

It should be stated that, rather than water being directed off a side(s) of the shower floor, (or in combination with this), it is feasible there may be provided an aperture arrangement in the shower floor, for water to travel through, for water to be directed from the shower floor, (and not travel through the receiving area of the toilet)). In FIG. 12, an example is shown of an example shower floor. There is shown an example aperture arrangement 70 in the shower floor, wherein the aperture arrangement is not above the receiving area of the toilet. The aperture arrangement comprises at least one aperture (and the example shown has only one aperture). However, in other embodiments, the aperture arrangement may comprise a plurality of apertures for water to travel through. The example shown is an example of an aperture arrangement, that is not positioned above the receiving area of the toilet). Arrow 77 denotes possible trajectory of water that has travelled through the example aperture arrangement 70 in the shower floor.

Figure 13:
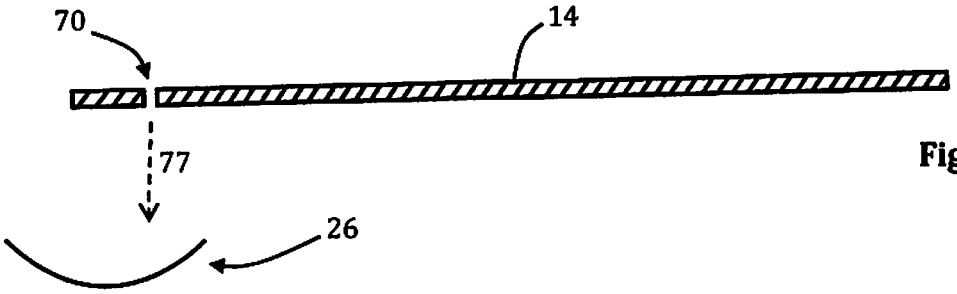
FIG. 13 is a side cross-sectional view of a similar or same example of a shower floor as shown in FIG. 12, showing possible trajectory of water, through the example aperture arrangement.
Figure 14:
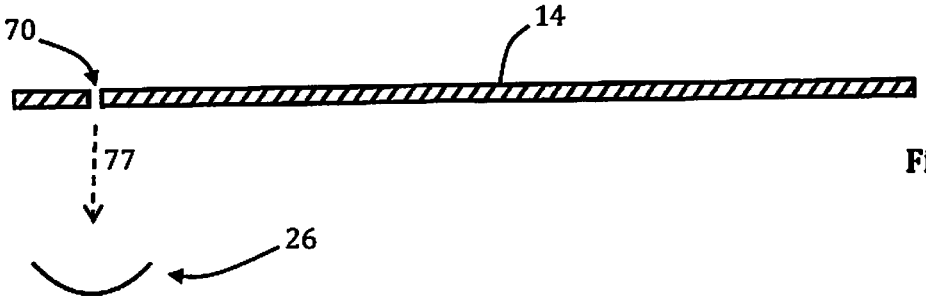
FIG. 14 is a side cross-sectional view of a similar example embodiment to what is shown in FIG. 13, showing an example of wherein a whole of an example catching area is within a perimeter of the shower floor, under the shower floor, when the shower floor is in the shower use position.

A cross-section of the same (or a similar) embodiment of a shower floor is shown in FIG. 13. (The receiving area of the toilet and the toilet itself are not shown in the Figure, simply to focus on the relevant feature(s), (eg the example aperture arrangement 70)). However, it will be apparent (especially if the toilet (and thus the receiving area of the toilet) are positioned, for example, in a position that is generally centrally below the shower floor, (eg similarly to other embodiments shown in the drawings), that the example aperture arrangement is not positioned above the receiving area of the toilet). As in the example of FIG. 6, for example, it can be seen that this is again an example of water not being directed through the receiving area of the toilet. Instead, in the example, (provided by way of example only), water that travels through the example aperture arrangement 70 goes into an example catching area 26. (Preferably water is directed into a catching area. However, embodiments may be provided wherein there is not provided a catching area (and where water is nevertheless directed off of the shower floor via sloping of a portion or a whole of the shower floor). In the example, (with regard to the shower floor in the shower use position), a portion or a whole of the example catching area is within a perimeter of the shower floor, (under the shower floor). In other embodiments, a whole of the catching area may be within a perimeter of the shower floor, (under the shower floor). (This may depend on placement of the aperture arrangement). (An example of a whole of the catching area being within the perimeter of the shower floor, (under the shower floor), is shown in the example of FIG. 14). Whether water is directed off a side(s) of the shower floor, or through an aperture arrangement that is not positioned above the receiving area of the toilet, embodiments may be provided wherein a portion of the (or any) catching area is within the perimeter of the shower floor, (under the shower floor). However, it should also be stated that embodiments may be provided wherein a whole of the (or any) catching area is outside of the perimeter of the shower floor. (An example of this is best shown in the example of FIG. 10, for example, where it can be seen that not even a portion of the example catching area is within the perimeter of the shower floor, (under the shower floor)). In this example, water is directed off a side(s) of the shower floor, into the example catching area).

In both FIG. 13 and FIG. 14, basic representation is shown. The example catching areas are shown in basic fashion. Other feature(s), (such as the toilet, and channel(s) etc that water may, or may not, be directed into and/or through) are not shown, in order to provide clarity as to what is shown/depicted. However, as shown by virtue of the example of FIG. 6, for example, water may, (or may not), flow through other channel(s) etc, and the examples of FIGS. 12 to 14 are not limited only to comprising the features shown, and may draw upon (and be afforded) any other feature(s)/disclosure of the present application, (which will be apparent). (It should also be stated that, as stated (and made clear) in the present application, embodiments may be provided wherein there is not provided a catching area. For example, (taken by way of example only), due to sloping of the portion or the whole of the shower floor, water may be directed from the shower floor (into the water system of the toilet, for example), without there being a catching area. Thus what is shown is just a basic example embodiment, shown in basic fashion, simply for clarity, and not limiting, with regard to water being directed from the shower floor, (without travelling through the receiving area of the toilet)).

(Broadly speaking, (and not limited by any other feature(s)/disclosure, for example)), there may be provided a catching area, (the catching area not being the pan of the toilet). With regard to the shower floor in the shower use position, a portion or a whole of the catching area may be within the perimeter of the shower floor, (under the shower floor)). With regard to the shower floor in the shower use position, a portion or a whole of the catching area may be outside the perimeter of the shower floor, (under the shower floor).

Thus preferably, in the shower use mode, a portion or a whole of the shower floor is sloped, to facilitate directing water from the shower floor, and wherein, due to the portion or the whole of the shower floor being sloped, water from the shower floor is directed at least one of: off a side of the shower floor; through an aperture arrangement in the shower floor, wherein the aperture arrangement is not positioned above the receiving area of the toilet.

Both examples (ie the example (eg in FIG. 6) of water being directed off a side(s) of the shower floor, (due to sloping of a portion or a whole of the shower floor)), and the example (eg as shown in the examples of FIGS. 12 to 14) of there being an aperture arrangement in the shower floor, (the aperture arrangement not being positioned above the receiving area of the toilet), through which water is directed, (due to sloping of a portion or a whole of the shower floor), are examples of wherein water from the shower, due to sloping of a portion or a whole of the shower floor, is directed from the shower floor, (and does not travel through the receiving area of the toilet). (This differentiates from what was mentioned previously, where there may be provided an aperture arrangement, to facilitate directing water through the receiving area of the toilet, into the pan of the toilet). Nevertheless, as seen in the example of FIG. 6, (and which may be relevant to other embodiments), the water may nevertheless be directed into the pan of the toilet, (despite the fact that water does not travel through (and thus by-passes) the receiving area of the toilet). In other embodiments, water from the shower may not be directed into the pan of the toilet at any point. (It may, for example, (provided by way of example only), be directed into other area(s) of the water system of the toilet, (without (or in combination with) going into the pan of the toilet). For example, it may feasibly be directed into a pipe(s), (eg a waste pipe(s)), of the water system of the toilet, (and may never go into the pan of the toilet)).

As alluded to, a portion or a whole of the (or any) stopping arrangement may be sloped. (This may facilitate drainage of water). (As alluded to, a portion or a whole of the (or any) stopping arrangement being sloped may facilitate stopping the shower floor in a sloped position). It should also be stated, a stopping arrangement that is not sloped may nevertheless facilitate the shower floor being stopped in a position wherein a portion or a whole of the shower floor is sloped, (to facilitate directing water from the shower floor). For example, an embodiment of a stopping arrangement may be provided wherein the shower floor is stopped in a sloping position, (irrespective of whether a portion or a whole of the stopping arrangement is sloped). An example of this, for example, would be wherein a feature(s) that protrudes inwardly at a side(s) of the shower, (eg a knob(s), bar(s), etc), (a bar(s) being an example of a feature(s) that travels from one side of the shower (and which may perhaps travel to another side of the shower, for example)), a bar(s) being just one example of a feature(s) that travels from one side of the shower (and which may perhaps travel to another side of the shower, for example), such feature(s)/example(s) not limited to being/comprising a bar(s)), (or any relevant stopping feature(s) at all—for example, it has been alluded to that a support arrangement that engages a ground surface, in the shower use mode, for example, may act as a stopping arrangement)), stops the shower floor (eg in an embodiment wherein the shower floor is rotatably movable from the non-use position to the shower use position), at a position before it has rotated to flat/horizontal. (This is just one example, and it will be apparent that such a concept/embodiments is not limited to embodiments wherein the shower floor is rotatably movable. Such (stopping) feature(s) may be provided/used for any embodiment, (and may stop the shower floor in a position that is not flat/horizontal) not limited to embodiments wherein the shower floor is rotatably movable). Thus examples/disclosure are provided of wherein the shower floor is stopped in a sloping position.

Furthermore, it should be stated, feature(s) may be provided that are moved (in order to protrude inwardly at a side(s) of the shower, and stop the shower floor in the shower use position). For example, a bar(s) (or any feature(s)) may be used, which needs to be moved, (eg pulled out, rotated, placed (ie may be manually placed by the user, eg if it is stored or placed aside when the combined toilet and shower arrangement is in the toilet use mode), attached, etc), to thus stop the shower floor in the shower use position. It should be stated, even such a feature(s) that needs to be (and/or is) moved, to perform such a function, if it protrudes inwardly at a side(s) of the shower, and the shower floor engages with it, once moved, (to stop the shower floor in the shower use position), is considered within the scope of being a feature(s) that protrudes inwardly at a side(s) of the shower, (and which the shower floor engages), to stop the shower floor in the shower use position, (and is thus a portion or a whole of a stopping arrangement that protrudes inwardly at a side(s) of the shower, (and which the shower floor engages), to stop the shower floor in the shower use position), (even if it does not protrude inwardly at a side(s) of the shower before it is moved).

Furthermore, as has been alluded to, it is possible embodiments may be provided wherein a portion or a whole of the shower floor is sloped, (to facilitate directing water from the shower floor), even wherein there is a stopping arrangement that stops the shower floor in a flat (horizontal) position. For example, the shower floor may be horizontal/flat (eg on a portion or a whole of its underside), but may be shaped in such a way (eg with a portion or a whole of its top surface being sloped, to facilitate drainage), to facilitate drainage. Thus embodiments may be provided wherein there is a stopping arrangement that stops the shower floor in a flat/horizontal position, and yet nonetheless, wherein a portion or a whole of the shower floor is sloped, (to facilitate directing water from the shower floor). (As stated, it will be apparent that stopping feature(s) of a wide variety of shapes and/or sizes may be provided, (as has already been alluded to). Thus a wide variety of stopping arrangements may be provided, in varying embodiments).

(It should also be stated that any embodiments wherein a portion or a whole of the shower floor is sloped, (to facilitate directing water from the shower floor), may feasibly benefit from (and/or be afforded) disclosure relating to (ie may comprise) an aperture arrangement that is not positioned above the receiving area of the toilet, (whether or not a portion or a whole of the underside of the shower floor is flat, in the shower use position, or not)). (Thus it should also be stated that embodiments wherein the shower floor is stopped in a flat/horizontal position, (and where a portion or a whole of the shower floor is sloped (to facilitate directing water from the shower floor)), may benefit from (and/or be afforded) disclosure relating to (ie may comprise) an aperture arrangement that is not positioned above the receiving area of the toilet. (Thus an embodiment(s) may be provided, for example, wherein a portion or a whole of the shower floor is sloped (to facilitate directing water from the shower floor), a portion or a whole of the underside of the shower floor is flat/horizontal in the shower use position, and there is an aperture arrangement in the shower floor, wherein the aperture arrangement is not positioned above the receiving area of the toilet). (It should also be stated, more broadly speaking, that embodiments wherein the shower floor is stopped in a flat/horizontal position may otherwise benefit from (and/or be afforded) any disclosure in the present application that is provided/disclosed relating to/for embodiments wherein the shower floor is stopped in a sloped position, for example, (and vice versa))).

Preferably the combined shower and toilet arrangement comprises a stopping arrangement, to stop the shower floor in the shower use position. Preferably the stopping arrangement protrudes inwardly at a side of the shower, and the shower floor engages it, to stop the shower floor in the shower use position. (This has already been alluded to). (What is shown in the examples of FIGS. 7 to 9 is an embodiment of this). The stopping arrangement (and any relevant stopping feature(s) of the stopping arrangement) may be provided at any side(s) of the shower, (eg left side and/or right side, and/or front (side), etc). Preferably, the stopping arrangement protrudes inwardly at opposing sides (of the shower). (This has been alluded to). Preferably, the stopping arrangement protrudes inwardly at a left side and a right side (of the shower).

In some embodiments, (as stated), the stopping arrangement may be provided by way of (and thus may, broadly speaking, comprise) a ledge(s), that extends/protrudes from the side of the shower. An example of this, for example, would be if there is a step(s) in a side of the shower. (The side(s) of the shower may be provided by way of a wall(s), and/or may not (eg via there being a screen(s), etc)). (This has been discussed/alluded to). An example of a step(s), for example, (provided by way of example only), would be if there is a wall(s), (which is a side of the shower), and wherein there is step in the wall(s). Thus where there is an inward step(s), the shower floor may be able to rest on the step(s), thus stopping the shower floor (in the shower use position). Thus this is an example of there being provided a stopping arrangement that protrudes inwardly at a side of the shower, and which the shower floor engages, to stop the shower floor in the shower use position. (There may be provided a ledge at opposing sides of the shower. There may be provided a ledge at a left side and a right side (of the shower)). Thus various embodiments of a stopping feature(s) that protrudes inwardly at a side of the shower, and which the shower floor engages, to stop the shower floor in the shower use position, may be provided, (all being within the scope of a stopping arrangement that protrudes inwardly at a side of the shower, and which the shower floor engages, to stop the shower floor in the shower use position). The (or any) stopping arrangement that protrudes inwardly at a side of the shower, (and which the shower floor engages, to stop the shower floor in the shower use position), may comprise any feature(s) that protrudes inwardly at a side of the shower, (and which the shower floor engages, to stop the shower floor in the shower use position).

(Nate, the term 'step' in the side(s), (eg wall(s)), here does not refer to a step that is intended, (at least not primarily), 'for stepping on' by a user. It is a term used to refer to structural shape of the side(s), (eg wall(s)). (With reference to a step(s), at the point from which the side(s) protrude inwardly, (to form the step(s)), the side(s) tend to then continue (to be protruding) to the bottom of the side(s) (eg wall(s)), (eg going downward, straight, or substantially straight). However, it is feasible there could be embodiments wherein a step(s) protrudes inwardly, but then, lower down the side(s), (eg wall(s)), does not protrude as much (eg is recessed, for example) as it does higher up the side(s), (eg wall(s)). (It is also even feasible that the step(s) may protrude further inwardly, lower down the side(s), (eg wall(s)))).

Whilst examples have been shown of a toilet paper holder 32 being provided on an underside of the shower floor, it should be stated, more broadly speaking, the (or any) toilet paper holder may be provided on the shower floor, (ie not limited to being provided on the underside of the shower floor). (So the same is the case for the (or any) user means 36, to activate flushing of the toilet). Thus, broadly speaking, the (or any) user means, to activate flushing of the toilet may be provided on the shower floor, (ie not limited to being provided on the underside of the shower floor).

Figure 15:
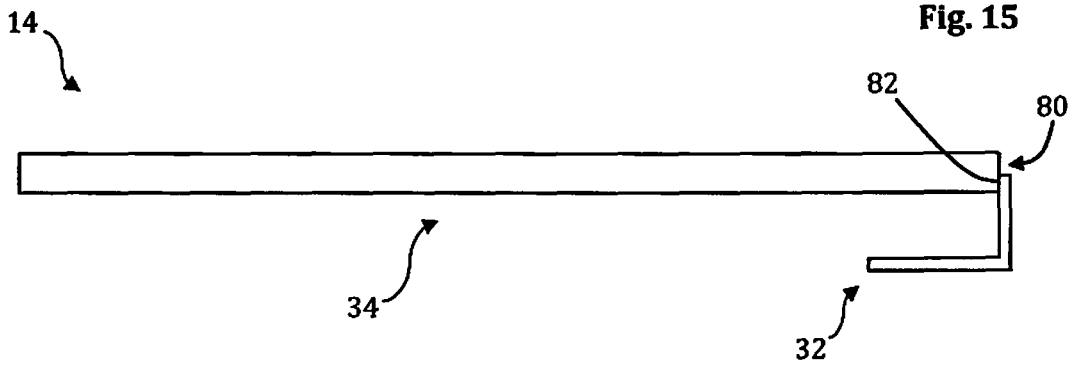
FIG. 15 is a front view of an example shower floor, showing an example of a toilet roll holder being provided on the example shower floor.

Examples of this are shown in FIG. 15 to FIG. 18. In FIG. 15, an example is shown of a toilet roll holder that is (at least partially) on a side facing portion 80 of the shower floor. In the example, an example is shown of wherein a toilet roll holder is attached at a side facing portion of the example shower floor. In the example, the example toilet roll holder is attached to an example side facing surface of the shower floor. (The toilet roll holder may be attached in any way (eg via screw(s), clip(s), adhesive(s), etc, or any other way). The example toilet roll holder is attached, in the example, at point 82. (As stated previously, the (or any) toilet paper holder is not limited to being a toilet roll holder).

Of course, the toilet paper holder (and/or the user means, to activate flushing of the toilet), may be provided on the top surface of the shower floor. However, it will be apparent that this may be extremely unwise and/or problematic, as it may make it very likely (or guaranteed) that water (from the shower) will go onto the toilet roll holder (and/or the user means, to activate flushing of the toilet), when the shower is being used. The toilet paper holder (and/or the user means, to activate flushing of the toilet) may also be stepped on by the user, (when the user uses the shower) if either (or both) are provided on the top surface of the shower floor. (In other words, the toilet roll holder (and/or the user means, to activate flushing of the toilet) being provided on the top surface of the shower floor may cause problems, in the shower use mode. Therefore preferably the toilet paper holder (and/or the user means, to activate flushing of the toilet) are provided on the shower floor, but not on the top surface of the shower floor.

Figure 16:
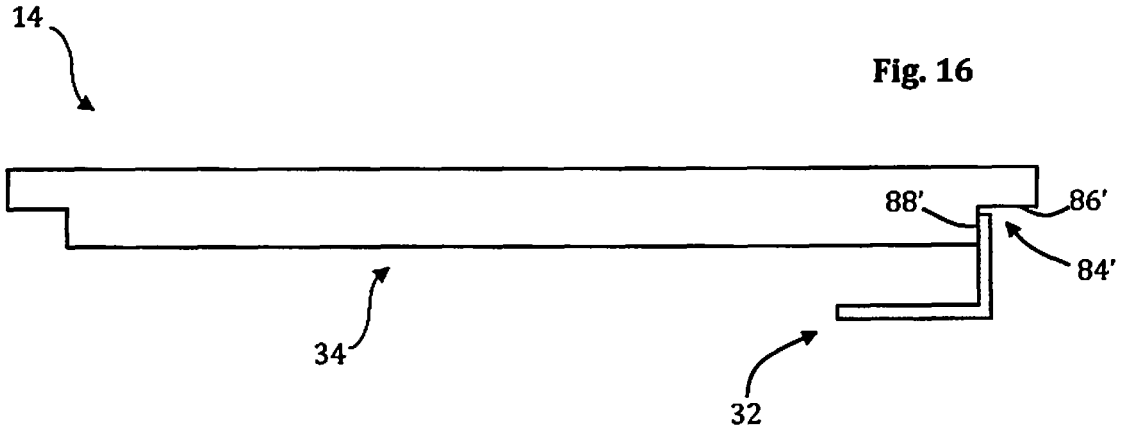
FIG. 16 is a front view of another example embodiment of a shower floor, again showing an example of a toilet roll holder that is provided on the shower floor.

There is shown another example in FIG. 16. In FIG. 16, there is an example overhang 84'. In the example, the overhang comprises (and/or creates) example surface 86' and example surface 88'. (In the example, the toilet roll holder is attached to example surface 88'). In the example, example surface 88 is a side facing surface. However, it should be stated, for the sake of the present application, that surface is considered to be part of the underside of the shower floor. (Thus what is shown in FIG. 16 is an example of the toilet paper holder being provided on the underside of the shower floor). (The (or any) overhang may be useful for resting on a stopping arrangement, to stop the shower floor in the shower user position). Thus, for example, in the example, example surface 86' may engage with a stopping arrangement, to stop the shower floor in the shower user position). In the example shown, the shower floor has an overhang at more than one side of the shower floor. In other examples, there may be an overhang at one side of the shower floor, for example). Thus, broadly speaking, (and whether the or an overhang continues around the shower floor, or not), one or more of the sides of the shower floor may overhang.

Figure 17:
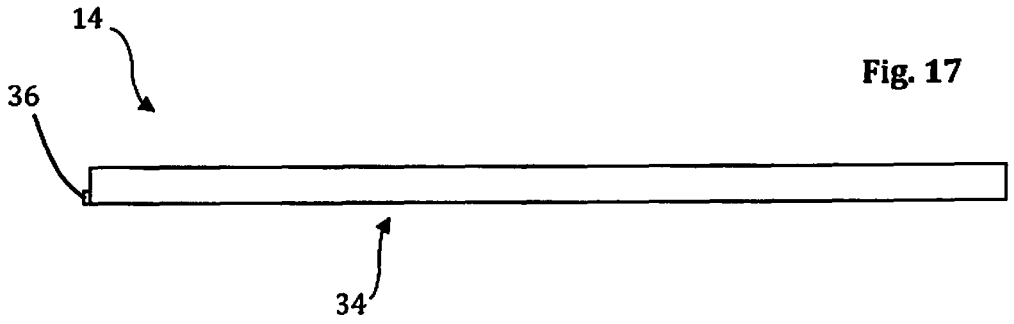
FIG. 17 is a front view of an example shower floor, showing an example of a user means, to activate flushing of the toilet, being provided on the example shower floor.
Figure 18:
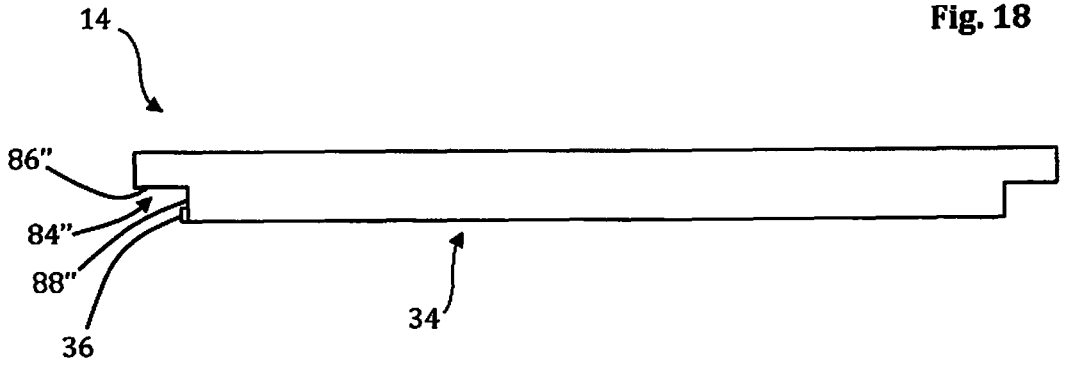
FIG. 18 is a front view of another example embodiment of a shower floor, again showing an example of a user means, to activate flushing of the toilet, being provided on the shower floor.

So the same is the case (as has been described with reference to the toilet paper holder being provided on the shower floor (and with reference to description and/or disclosure relating to the examples of FIG. 15 and FIG. 16) for the (or any) the user means 36, to activate flushing of the toilet. (Thus similar examples are shown/provided in FIGS. 17 and 18. In FIG. 17, the example user means is shown provided on a side facing portion of the shower floor, (similarly to the example toilet roll holder in FIG. 15). In the example of FIG. 18, there is shown an example overhang 84" (similar to the example of FIG. 16 with the toilet roll holder). In the example, the overhang comprises (and/or creates) example surface 86" and example surface 88". In the example, the example user means 36 is on example surface 88". In the example, example surface 88" is a side facing surface. However, it should be stated, for the sake of the present application, that surface is considered to be part of the underside of the shower floor. (Thus what is shown in FIG. 16 is an example of the user means 36, to activate flushing of the toilet, being provided on the underside of the shower floor). (The (or any) overhang, as previously stated, may be useful for resting on a stopping arrangement, to stop the shower floor in the shower user position).

In the examples shown, the user means is depicted as a protruding feature. Although the user means may protrude is such a way (in various embodiments), it should be stated, what is shown is shown by way of example only, (and to provide clarity as to what is being shown/disclosed). In other embodiments, the (or any) user means, to activate flushing of the toilet, may not protrude at all. Furthermore, it should be stated, the user means may be touchless. (A touchless user means may, or may not, protrude). (In the example, the fact that the user means appears to protrude suggests that it is an embodiment which requires touching (eg comprising a button, for example). (It may be depressible, to activate flushing, for example). However, as stated, the user means may be a touchless user means.

These basic example embodiments are provided, simply to show the toilet paper holder (and/or the user means, to activate flushing of the toilet) may be provided on the shower floor, in various different places and/or ways and/or embodiments. It should also be stated, it is feasible embodiments may be provided where the toilet paper holder (and/or user means, to activate flushing of the toilet) are partially on a side facing surface of the shower floor. (The toilet paper holder (and/or user means) may then also be partially on the top surface, or partially on the underside of the shower floor, for example). Similarly, examples may be provided wherein the toilet paper holder (and/or user means, to activate flushing of the toilet) are partially on an underside of the shower floor. (The toilet paper holder (and/or user means) may then also be partially on a side facing surface of the shower floor, for example).

Figure 19:
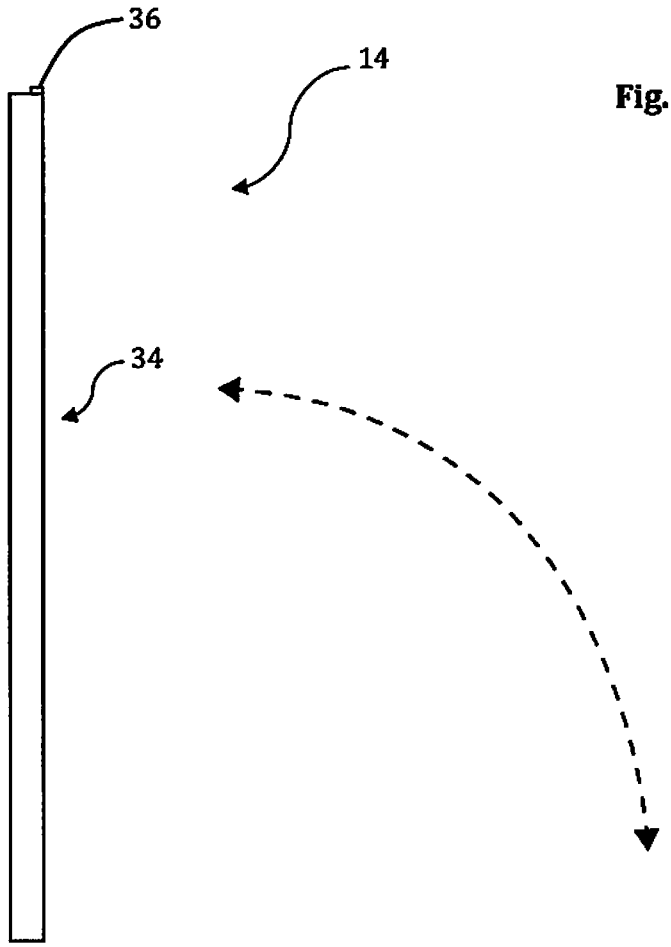
FIG. 19 is a side view of a basic representation of an example shower floor, showing an example of a user means, to activate flushing of the toilet, provided on the shower floor, and showing the shower floor in the toilet use position.

(Note: 'side facing' is not limited to the left and right side of the shower floor. For example, it could be at the front side of the shower floor, for example. Thus, rather than the term 'side facing' (and 'side facing portion(s)'), the term 'outward facing' (and 'outward facing portion(s)') may also be used, (and is appropriate). In FIG. 19, for example, an example embodiment is shown, (now showing an example embodiment of the shower floor in the toilet use position). In this example, there is shown an example user means 36, to activate flushing of the toilet. The example user means is shown provided on what, when the shower floor is in the shower use position, is a front 'outward facing' portion of the shower floor. The user means, in the example, is nevertheless well accessible to the user, to activate flushing. (The large arcing double-arrowed dashed line in FIG. 19 denotes, if the shower floor is rotatably movable, a possible rotational arc (ie arc of rotation) as the shower floor rotates between the toilet use and shower use positions)).

(It should be stated, whilst FIGS. 15 and 16 show only a toilet paper holder (not a user means, to activate flushing of the toilet), and FIGS. 17 and 18 show only a user means, to activate flushing of the toilet, (not a toilet paper holder), it should be stated, (as will be clear from the disclosure of the present application) that various permutations/combinations are possible. (For example, both the user means and the toilet paper holder may be provided in such positions/locations, (eg on one, (or opposing and/or other), side facing surface(s)) of the shower floor. In other embodiments, one, or the other, may be provided on the shower floor, and the other may, for example, be provided elsewhere (at any other location/place, not limited to being on the shower floor). Thus a wide variety of embodiments are possible, as will be apparent from the nature of the disclosure of the present application. (It should also be stated that it has been stated (and shown) that, preferably the toilet paper holder and/or use means, for activating flushing the toilet, are provided on the shower floor. However, as will be apparent in the present application, one (or both) may be provided, not at all limited to being provided on the shower floor. (Thus the toilet paper holder and/or user means, to activate flushing the toilet, may be provided anywhere, (not limited to being provided on the shower floor))).

Thus, preferably there is provided on the shower floor at least one of: a toilet paper holder; a user means, to activate flushing of the toilet. (Preferably both the toilet paper holder and the user means to activate flushing of the toilet are provided on the shower floor).

Figure 20:
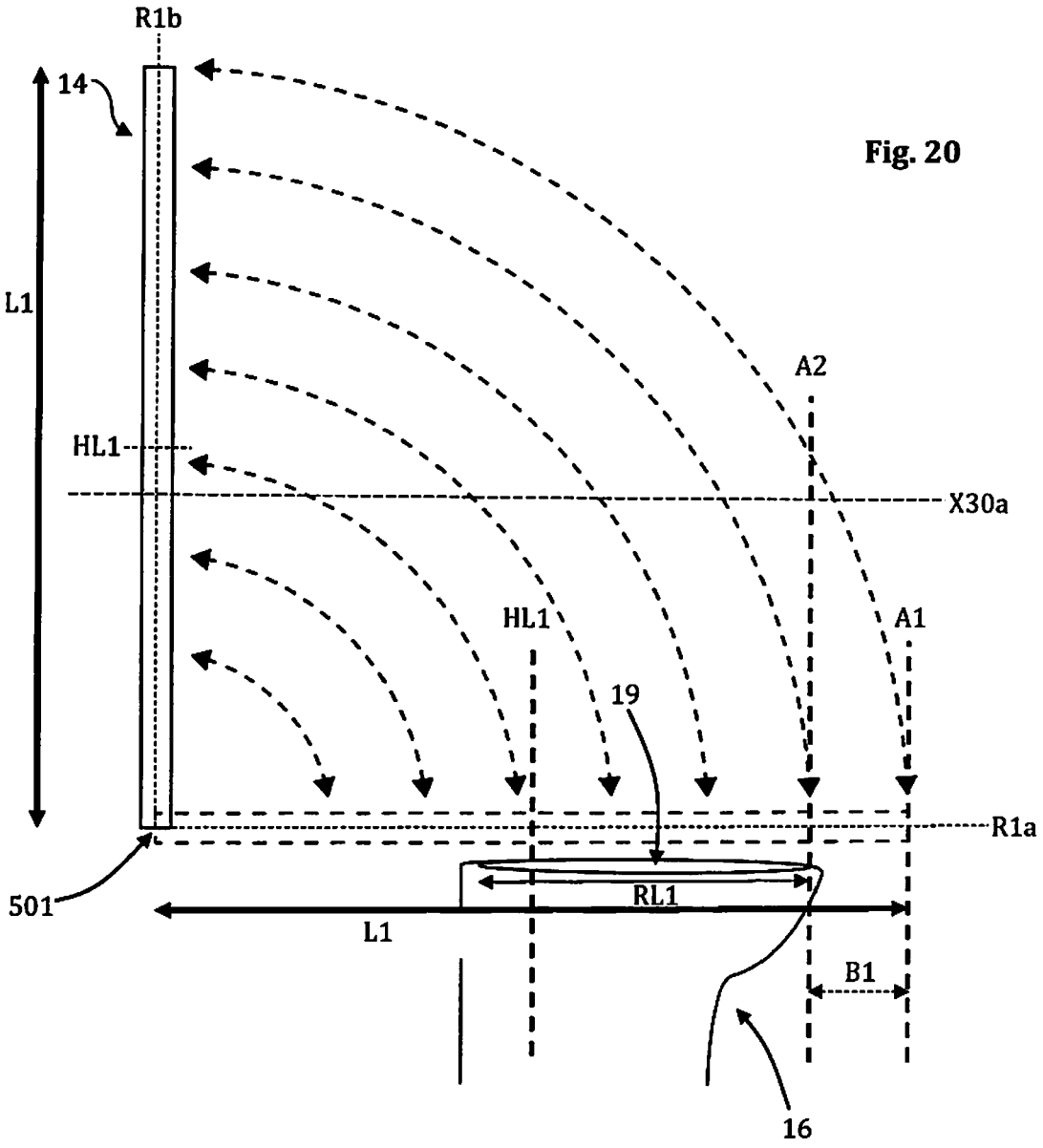
FIG. 20 is a side view, showing clearly an embodiment wherein, at a lowest point of rotation of the shower floor, from a side view, more than half of the shower floor does not extend past the receiving area of the toilet.

Preferably, the shower floor is rotatably movable from the non-use position to the shower use position, and from the shower use position to the non-use position, rotatably movable from behind the receiving area of the toilet; wherein rotation of the shower floor is configured so that a whole of the receiving area of the toilet is within a circular trajectory of an arc of rotation of the shower floor as it rotates from the non-use position to the shower use position, the whole of the receiving area of the toilet thus being under the shower floor when the shower floor is in the shower use position. Examples of this are shown in the drawings. However, a best depiction of this, (in terms of an understanding of this), is shown in FIG. 20 (and, to some extent, FIG. 19). To explain this, FIG. 20 of the present application is shown. In FIG. 20, the shower floor is shown in the non-use position. The shower floor is shown, generally having been rotated into a non-use position in the example, (and generally at approximately 90 degrees, (ie pointing directly upwards, in the example, for simplicity and clarity here, although, as has been stated, embodiments may be provided wherein the shower floor extends beyond vertical)). Added is also a representation of the shower floor, (shown in dashed lines), to show the shower floor in the shower use position. The curved double arrowed lines between the shower floor in the non-use position and the shower use position denote the 'rotational arc' (ie arc of rotation) of the shower floor, as it moves, in the example, from the non-use position to the shower use position, (and from the shower use position to the non-use position). Thus the curved double arrowed lines in FIG. 20, (between the shower use position and the non-use position), show the arc of rotation of the shower floor. However, if it is imagined the shower floor was able to rotate a whole 360 degree rotation, that would be the 'circular trajectory' of the arc of rotation of the shower floor. Thus, if it is imagined, in the example of FIG. 20, for example, that the shower floor was able to rotate 360 degrees around the example axis of rotation that the shower floor rotates about, it will be apparent that a whole of the receiving area of the toilet is within the circular trajectory of the arc of rotation of the shower floor. It can be seen that the rotational arc guarantees that the whole of the receiving area of the toilet is under the shower floor when the shower floor is in the shower use position, when the shower floor gets to the shower use position, (via being rotated). Thus this is an example of wherein rotation of the shower floor is configured so that a whole of the receiving area of the toilet is within the circular trajectory of the arc of rotation of the shower floor as it rotates from the non-use position to the shower use position.

(Nate: It should be stated, the present application clearly states that, in basic embodiment(s), it is feasible there could be a hole(s) in the shower floor that water from the shower can drain through, and into the basin of the toilet. It should be stated, even if such a hole(s) were present, it does not affect whether or not a whole of the receiving area of the toilet is within a circular trajectory of an arc of rotation of the shower floor as it rotates from the non-use position to the shower use position. (eg In the example of FIG. 20, for example, showing the arc of rotation, that example would still be within a scope of a whole of the receiving area of the toilet being within a circular trajectory of an arc of rotation of the shower floor as it rotates from the non-use position to the shower use position, even if the shower floor has hole(s) that water from the shower can drain through, and into the basin of the toilet. Thus, whether or not the shower floor in that example has hole(s) that water from the shower can drain through, and into the basin of the toilet, it would nevertheless be an example of wherein rotation of the shower floor is configured so that a whole of the receiving area of the toilet is within a circular trajectory of an arc of rotation of the shower floor as it rotates from the non-use position to the shower use position, the whole of the receiving area of the toilet thus being under the shower floor when the shower floor is in the shower use position).

Referring to FIG. 20, a side view of a clear example/depiction is shown, of an embodiment wherein the shower floor is rotatably movable from the non-use position to the shower use position, and from the shower use position to the non-use position, and wherein, throughout rotation of the shower floor from the non-use position to the shower use position, and from the shower use position to the non-use position, from a side view, not more than half of the shower floor is able to extend past a furthest point of the receiving area away from an axis of rotation about which the shower floor rotates. (The example shown shows an example of wherein rotation of the shower floor is configured so that, at a lowest point of rotation, more than half of the shower floor, from a side view, does not extend past the furthest point of the receiving area of the toilet away from an axis of rotation about which the shower floor rotates. Thus, in the example, with rotation of the shower floor having been completed, more than half of the shower floor, from a side view, does not extend past the furthest point of the receiving area away from the axis of rotation about which the shower floor rotates. (There are potentially dramatic advantages in terms of compactness in such a set-up). This is most clearly shown by virtue of dashed lines A1 and A2. Dashed line A1 defines the furthest most point of the shower floor, (away from an axis of rotation about which the shower floor rotates), (ie to where the shower floor extends, in the example). Dashed line A2 defines the furthest point of the receiving area away from the axis of rotation about which the shower floor rotates. (Thus, preferably, not more than half of the shower floor extends past a furthest point of the receiving area, (from a side view), away from an axis of rotation about which the shower floor rotates). (This is preferably also the case in embodiments, not limited to being rotatably movable, (ie that not more than half of the length of the shower floor (from a similar side view, for example) extends past the receiving area). However, it may be particularly useful for embodiments that are rotatably movable, (eg to create a compact rotatable embodiment)). Thus the distance between these two lines, (lines A1 and A2), (which is shown as double arrow B1), defines the amount of the shower floor that, from a side view, extends past the receiving area of the toilet. As can be seen, it is only a small amount, in the example, that extends past the receiving area of the toilet. (It is clear that the amount that extends past the receiving area of the toilet is far less than a half of the shower floor, from a side view).

Thus this is an example of wherein more than half of the shower floor, from a side view, does not extend past the furthest point of the receiving area of the toilet away from the axis of rotation about which the shower floor rotates. (Simply for clarity, dashed line HL1 is also included, which is half way along the shower floor, from a side view, (ie showing half of the shower floor, from a side view, either side of dashed line HL1). The other drawings also show examples of this, most notably FIG. 6. FIG. 1 also shows an example embodiment of wherein at a lowest point of rotation, for example, more than half of the shower floor, from a side view, does not extend past the furthest point of the receiving area away from the axis of rotation about which the shower floor rotates, (although it is relatively close to this not being the case, (ie relatively close to not being within this scope), compared to some of the other embodiments shown).

(Thus it can be seen that, in the example shown, throughout rotation of the shower floor from the non-use position to the shower use position, and from the shower use position to the non-use position, not more than half of the shower floor is able to extend past a furthest point of the receiving area, from a side view, away from a point of rotation about which the shower floor rotates, (ie not more than half of the shower floor is able to extend past dashed line A2). This is clear, (even at a lowest point of rotation of the shower floor). Thus, preferably, throughout rotation of the shower floor from the non-use position to the shower use position, and from the shower use position to the non-use position, from a side view, not more than half of the shower floor is able to extend past a furthest point of the receiving area away from an axis of rotation about which the shower floor rotates, (ie not more than half of the shower floor is able to extend past dashed line A2)).

(It should be noted, in the example embodiment of FIG. 20, only a basic representation of the toilet is shown. However, it should be stated, the toilet may be afforded any feature(s)/disclosure relating to the or any toilet in the present application, and it will be apparent that the example toilet is represented in basic fashion. (There may be pipe(s)/piping, etc, for example. Such feature(s) are not shown, simply due to the fact that FIG. 20 is a basic representation, and is intended to focus more on position of the shower floor, for example)).

(In the example, the example shower floor is also shown slightly sloped, in the shower use position. Thus it is an example of a portion or a whole of the shower floor being sloped, to facilitate directing water from the shower floor).

(Nate: it is technically feasible that an embodiment may be provided wherein a whole of the receiving area of the toilet is within a circular trajectory of the arc of rotation of the shower floor, (as it rotates from the non-use position to the shower use position), but wherein, at the lowest point of rotation of the shower floor, more than half of the shower floor, from a side view, extends beyond the furthest point of the receiving area of the toilet away from the axis of rotation about which the shower floor rotates. However, more than half of the shower floor, from a side view, will tend not to extend beyond the receiving area of the toilet, for embodiments wherein a whole of the receiving area of the toilet is within a circular trajectory of the arc of rotation of the shower floor, (as it rotates from the non-use position to the shower use position).

(Nate, in FIG. 20, (and several other Figures), a lid and/or toilet seat of the toilet may not be shown. Preferably, (whether shown or not), there is provided a toilet seat.

Preferably, (whether shown or not), there is provided a lid for the toilet. (Preferably both are provided)).

Thus it should be stated, (broadly speaking), that preferably the toilet comprises a toilet seat. An example(s) is shown, in various drawings, of a rotatable toilet seat, for example. For example, in the example of FIG. 4, an example rotatable toilet seat is shown up, (rotated up). In FIG. 2, for example, an example rotatable toilet seat is shown down. (These are shown by way of example only).

Similarly, (broadly speaking), preferably there is provided a lid for the toilet. In various examples in the drawings, an example(s) is shown of a rotatable toilet lid. An example rotatable toilet lid is shown, up, in the example of FIG. 5, for example. An example rotatable lid is shown, down, in FIG. 1, for example.

In the toilet use mode, the shower floor may extend beyond vertical. (This can allow it to maintain its position due to gravity).

The combined shower and toilet arrangement may comprise a holding arrangement, to hold the shower floor in the non-use position. The holding arrangement may hold the shower floor to a back wall behind the toilet, in the toilet mode. (As stated, the shower floor may extend beyond vertical, in the toilet use mode, (and this can allow it to maintain its position due to gravity)).

Preferably, the combined shower and toilet arrangement comprises a flow arrangement, to direct water from the shower floor, into a water system of the toilet.

Preferably the flow arrangement is configured to direct water from the shower floor, into a pan of the toilet.

Preferably there is provided a catching area, to catch water from the shower.

Preferably there is provided a support arrangement to support the shower floor in the shower use mode.

The combined shower and toilet arrangement may be transportable, assembled together.

The combined shower and toilet arrangement may comprise a water tank, for the toilet. (Water tanks are often used to store water). The water tank may be behind a wall, (and may thus not be within the shower).

Various examples are shown in the drawings of wherein there is provided an elongate channel(s).

It has been stated that, whilst the toilet flush user means may feasibly be a mechanical user means, (such as a rotatable lever, for example, which initiates flushing), this may be fairly challenging to engineer, (taking into account the movement of the shower floor). In embodiments wherein the user means is provided on the shower floor, such a solution may involve the user means moving a feature(s) (eg a chain, or any feature(s)), with this feature(s) either itself (or via being connected with and/or interacting with another feature(s)), flushing the toilet. It will be apparent that various mechanical solutions may be provided. Thus, whilst this may be fairly challenging to engineer, (taking into account the movement of the shower floor between the shower use position and the non-use position), it is nevertheless plausible.

It has also been stated that preferably, the toilet flush user means 36 is an electronic user means. This is also plausible for an embodiment wherein the user means is provided on the shower floor. The user means may be wireless. If, however, there are wire(s), such wire(s) may be provided internally and/or externally to the shower floor.

Thus such wire(s) may be directed towards any location/part(s)/feature(s), (even to a location/part(s)/feature(s) away from the shower floor), to facilitate the toilet flushing.

Water from the shower floor may be directed into a flush channel of the toilet. An example of this is shown most visibly in the examples of FIG. 5 and FIG. 6. In the example, there is shown an example flush channel 99 of the toilet, (that water travels through, for flushing the toilet). (The example channel 99 is also an example of a channel 24, through which water from the shower is directed). In the example, the example flush channel is a flush pipe, (which is an example of a flush channel). (Thus, broadly speaking, the example shown (in FIG. 5 and FIG. 6, for example) is an example of wherein water from the shower floor is directed into a flush channel of the toilet). This may be achieved in various ways. For example, if the combined shower and toilet arrangement is achieved by retro-fitting to a toilet, then an aperture(s), (eg hole(s)), may be made in the (or any) flush channel of the toilet. (For example, this may be done forcibly). Thus an aperture(s) may be plumbed into the (or any) flush channel of the toilet). A similar (or same) method may be used, even if the combined shower and toilet arrangement is provided new, (as opposed to retrofitting a toilet, for example), (eg the (or any) flush channel may have an aperture(s), (eg hole(s)) forcibly made into it. (Broadly speaking, an aperture(s) may be plumbed into the (or any) flush channel of the toilet). Thus the same result, for example may be achieved. In other embodiments (and a different method), the (or any) flush channel, may be bespokely provided, (configured to receive water from the shower). (Thus it may be manufactured, (with relevant feature(s), to facilitate this).

Thus the or any flush channel may be manufactured with an aperture(s), (eg hole(s)/opening(s), or any area(s) to receive water from the shower). Various solutions may be provided for this. Thus, for example, the (or any) flush channel may be provided, with an aperture(s) in it, for example. (Thus forcible plumbing may not be required). This may be done in various ways. For example, a plurality of different channel parts, (eg pipes, for example) may be provided. For example, example channels in FIG. 5 and FIG. 6, for example, may be different parts, (eg different pipes, for example). The flush channel may be provided with an aperture(s), (eg hole(s)), in it, and the example channel (which is above the example flush channel, in the examples of FIG. 5 and FIG. 6) may be a different part, (eg different pipe, in the example). The two may then be connected together, (eg via a fitting, or in any other way), so water can travel into the flush channel. In other embodiments, example channels 24 in FIG. 5 and FIG. 6 could be provided as one part, (eg manufactured as one part). (Thus they may be bespokely manufactured as one part, for example). Thus various embodiments may be provided, wherein water from the shower is received by the flush channel of the toilet. (Generally/broadly speaking then, the (or any) flush channel may receive water from the shower. Thus the examples described (and shown) are examples of the (or any) flush channel receiving water from the shower).

Note: It has been shown, (and described) that pipe(s) may be provided, as channel(s). However, it should also be stated, a void that functions as a channel is considered to be within a scope of being a channel. Thus if a void is provided in a feature(s), and the void functions as a channel, that is considered to be an example of a channel. For example, some parts of toilets are often made of ceramic material(s), (eg porcelain, for example). If a void is provided in such a part(s)/feature(s), (not limited at all to ceramics, but may be any part(s)/feature(s) and may be any material(s)), and the void functions as a channel, then that is considered to be within the scope of being a channel. (A flush channel, for example, could feasibly be provided by way of a void in a toilet part(s)/feature(s)). Thus channel(s) may be provided by way of void(s). However, preferably channels, (eg as shown in the example channels 24 of FIG. 5 and FIG. 6, for example), are not provided by voids. Thus preferably the channel(s) are non-void channel(s). (It is also feasible that a combination of channel(s) that are void(s), and channel(s) that are non-void(s) may be provided). (It is feasible, (provided by way of example only) that a portion or a whole of a flush channel of the toilet may be provided by way of an elongate void, for example). (Examples of non-void channel(s) include, (but are not limited to), pipe(s), tube(s), etc).

It has been mentioned that preferably the shower floor is rotatably movable from the non-use position to the shower use position, (and from the shower use position to the non-use position). Examples are shown in the drawings wherein the shower floor is rotatably movable from behind the receiving area of the toilet. However, it should be stated, the shower floor being rotatably movable is not limited to the shower floor being rotatably movable from behind the receiving area of the toilet. For example, the shower floor could be rotatably movable from a left side (or right side), for example. This is just one example, to therefore show that the shower floor being rotatably movable is not limited to the shower floor being rotatably movable from behind the receiving area of the toilet.

Broadly speaking, (and not limited by any other feature(s)/disclosure, for example)), preferably there is provided a channel arrangement, (ie one or more channel(s)), through which water from the shower is directed. (The or any channel arrangement is not limited to having to direct water from the shower into the water system of the toilet. (The or any channel arrangement may or may not direct water from the shower into the water system of the toilet).

Preferably a portion or a whole of the channel arrangement is lower than a portion or a whole of an underside of the shower floor in the shower use position, (ie, preferably, with reference to the shower floor in the shower use position, preferably a portion or a whole of the channel arrangement is lower than a portion or a whole of an underside of the shower floor). (Examples are most visibly shown/denoted in FIG. 5 and FIG. 6, for example). A portion or a whole of the channel arrangement being 'lower' than a portion or a whole of an underside of the shower floor in the shower use position does not mean the said portion or the whole of the channel arrangement that is lower than the portion or the whole of the underside of the shower floor has to be within a perimeter of the shower floor. For example, if a portion or a whole of the channel arrangement that is lower than a portion or a whole of an underside of the shower floor in the shower use position, and is not within a perimeter of the shower floor, that is nevertheless an example of a portion or a whole of the channel arrangement being is lower than a portion or a whole of an underside of the shower floor in the shower use position. Similarly, if a portion or a whole of the channel arrangement that is lower than a portion or a whole of an underside of the shower floor in the shower use position, and is within a perimeter of the shower floor, that is also an example of a portion or a whole of the channel arrangement being is lower than a portion or a whole of an underside of the shower floor in the shower use position. Embodiments may be provided wherein a portion of the channel arrangement is lower than a portion or a whole of the underside of the shower floor in the shower use position and is within a perimeter of the shower floor, and a portion of the channel arrangement is lower than a portion or a whole of the underside of the shower floor in the shower use position and is not within a perimeter of the shower floor. (The example of FIG. 6 most visibly shows an example of this).

Preferably, throughout rotation of the shower floor from the non-use position to the shower use position, (and from the shower use position to the non-use position), from a side view with reference to rotation, at least a portion of the shower floor does not extend further in distance away from an axis of rotation about which the shower floor rotates than half a distance of length of the shower floor, the length of the shower floor being defined as length of the shower floor along the shower floor, along an angle of rotation the shower floor is angled at to the axis of rotation. This is shown in the example of FIG. 20, for example, (and denoted). Line L1 (shown in both orientations/positions in FIG. 20) is the length of the shower floor. (The 'length' is here length of the shower floor along the shower floor, along an angle of rotation the shower floor is angled at to the axis of rotation. (The angle of rotation the shower floor is angled at to the axis of rotation is denoted for both the example positions shown in the example of FIG. 20. In the non-use position of the shower floor denoted, for example, the angle of rotation the shower floor is angled to the axis of rotation is shown with dashed line Rib, (and is at approximately (or exactly) 90 degrees, in the example). In the shower use position of the shower floor in the example, the angle of rotation the shower floor is angled to the axis of rotation is shown with dashed line R1*a*. (In the example, the shower floor is slightly sloped. Thus, in the example dashed line R1*a* (the angle of rotation the shower floor is angled to the axis of rotation) is not exactly flat/horizontal. Instead, it is slightly angled).

(Referring to length of the shower floor along the shower floor, along an angle of rotation the shower floor is angled at to the axis of rotation, this distance is made clear and apparent in the example of FIG. 20 by arrowed lines L1). (Note: The side view shown is a side view, with reference to rotation, in the example shown). Looking at the shower floor in the non-use position, line HL1 cuts through the shower floor half way along the length of the shower floor, (ie half way along L1). It thus denotes a halflength of the shower floor (either side of that line). (Another line HL1 is also shown going through the shower floor in the shower use position. Again, it thus denotes a half length of the shower floor (either side of that line)). ('HL' is here simply shorthand for 'half length' or 'half of length'). It is extremely apparent that, in the example shown in FIG. 20, for example, throughout rotation of the shower floor from the non-use position to the shower use position, (and from the shower use position to the non-use position), at least a portion of the shower floor does not extend further in distance away from an axis of rotation about which the shower floor rotates than half a distance of length of the shower floor, the length of the shower floor being defined as length of the shower floor along the shower floor, along an angle of rotation the shower floor is angled at to the axis of rotation. (It is extremely clear, in the example, that, throughout rotation of the shower floor from the non-use position to the shower use position, (and from the shower use position to the non-use position), at least a portion of the shower floor remains within a distance of half of the length of the shower floor, from the axis of rotation. This has benefits in terms of compactness. (Thus what is shown is an embodiment of wherein, at no point during rotation of the shower floor, (from the non-use position to the shower use position, and from the shower use position to the non-use position), is the shower floor at a distance from the axis of rotation about which it rotates, greater than half of the length of the shower floor).

(Thus what is shown in the example of FIG. 20 is an example of wherein, throughout rotation of the shower floor from the non-use position to the shower use position, (and from the shower use position to the non-use position), from a side view with reference to rotation, at least a portion of the shower floor does not extend further in distance away from an axis of rotation about which the shower floor rotates than half a distance of length of the shower floor, the length of the shower floor being defined as length of the shower floor along the shower floor, along an angle of rotation the shower floor is angled at to the axis of rotation.

It is feasible embodiments may be provided wherein the shower floor may be distanced from the axis of rotation, (ie that the shower floor may be able to extend away, for example, from the axis of rotation about which it rotates), (eg if there is provided a slide mechanism, or any other mechanism that distances the shower floor from the axis of rotation about which it rotates). However, if such mechanism(s), or any feature(s) at all are provided, and the shower floor does in any way, at any paint, distance itself from the axis of rotation about which it rotates, preferably it is not distanced further from the axis of rotation about which it rotates than half the length of the shower floor.

(As stated, the example of FIG. 20 is an example of wherein, throughout rotation of the shower floor from the non-use position to the shower use position, (and from the shower use position to the non-use position), at least a portion of the shower floor does not extend further in distance away from the axis of rotation about which the shower floor rotates than half a distance of length of the shower floor (made especially clear/apparent in light of use of the dashed lines HL1)). In the example shown, the shower floor, throughout rotation from the non-use position to the shower use position, (and from the shower use position to the non-use position), does not distance itself at all. In other embodiments, it may distance itself slightly, but not by much, for example. (However, preferably, there is no distancing. Preferably there is no mechanism(s) that distances the shower floor from the axis of rotation about which it rotates).

Dashed line X30*a* is shown. Dashed line X30*a* denotes a distance 30 cm in distance higher than the axis of rotation about which the shower floor rotates. Preferably, throughout rotation of the shower floor from the non-use position to the shower use position, (and from the shower use position to the non-use position), at least a portion of the shower floor is no more that 30 cm higher than the axis of rotation about which the shower floor rotates. (The example of FIG. 20 is clearly an example of this).

More preferably, preferably, throughout rotation of the shower floor from the non-use position to the shower use position, (and from the shower use position to the non-use position), at least a portion of the shower floor is no more than 20 cm higher than the axis of rotation about which the shower floor rotates. Still more preferably, preferably, throughout rotation of the shower floor from the non-use position to the shower use position, (and from the shower use position to the non-use position), at least a portion of the shower floor is no more than 10 cm higher than the axis of rotation about which the shower floor rotates. Still even more preferably, preferably, throughout rotation of the shower floor from the non-use position to the shower use position, (and from the shower use position to the non-use position), at least a portion of the shower floor is no more than 5 cm higher than the axis of rotation about which the shower floor rotates. (The example of FIG. 20, for example, is an example of all these, (ie no more than 30 cm, no more than 20 cm, no more than 10 cm, and no more than 5 cm). (If such dimension definition(s) is used, applicant reserves the right to use any amount of 30 cm or less than 30 cm (ie 29 cm, 28 cm, 27, cm, etc), all the way from 30 cm to zero cm, for example, not only limited to the example dimension definitions provided, which are provided by way of example).

(Note: In the example of FIG. 20, (provided by way of example only), the receiving area may be, for example, 30 cm from start to finish. (The most left point of the receiving area, (and arrow RL1), (from the side view shown in the example of FIG. 20), could be considered to be the start of the receiving area, in the example, and the most right point of the receiving area, (and arrow RL1), (from the side view shown in the example of FIG. 20), could be considered to be the end of the receiving area, in the example. If length RL1 is in fact 30 cm, for example, then dashed line X30*a* also happens to denote/define a distance higher than the axis of rotation that is the distance of length of the receiving area (ie 30 cm, in the example). Preferably, throughout rotation of the shower floor from the non-use position to the shower use position, (and from the shower use position to the non-use position), at least a portion of the shower floor is no more than the length of the receiving area, (ie length of RL1) higher than the axis of rotation about which the shower floor rotates. (In other examples, length of RL1 may not be 30 cm, (which will be apparent)). Nevertheless, (not limited to 30 cm), preferably, throughout rotation of the shower floor from the non-use position to the shower use position, (and from the shower use position to the non-use position), at least a portion of the shower floor is no more than the length of the receiving area, (ie length of RL1) higher than the axis of rotation about which the shower floor rotates, (whatever the length of RL1 may be for that embodiment).

(Nate: dashed lines, etc in FIG. 20 may not be absolutely exact in terms of positions and dimensions they are intended to define and show. However, it is believed they are either exact, or extremely close to exact, and that they successfully help portray what is being defined and/or disclosed).

(Nate: The axis of rotation (about which the shower floor rotates), in the example of FIG. 20, would be/appear simply as a 'dot', (if denoted), (due to the side view shown). (It is generally pointed to with arrow and feature number 501). However, it would, in fact, be a line (that travels through the dot). It will be apparent what the axis of rotation (about which the shower floor rotates) is, in FIG. 20, (especially in light of showing the shower floor both in an example shower use position, and in an example non-use position). However, it should be stated, the example provided is provided by way of example only, and it will be apparent that various differing embodiments may be provided, which may vary significantly from the example(s) shown).

Figure 22:
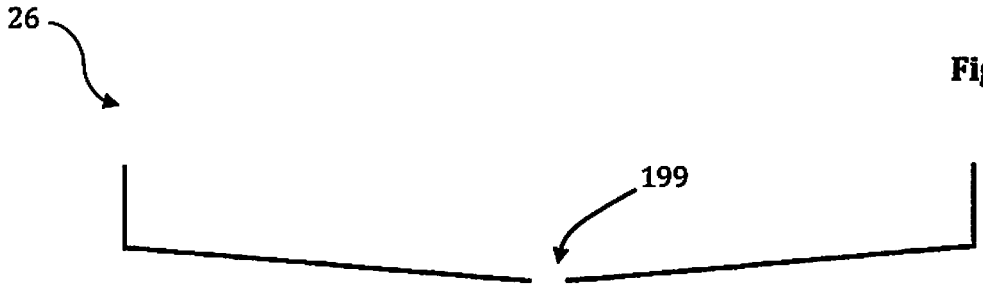
FIG. 22 is a basic front, or back, cross-sectional view of an example catching area, wherein a portion or a whole of the catching area is sloped.

Preferably a portion or a whole of the catching area 26 is sloped. (This may help direct water). An example(s) if this is shown in the examples of FIG. 22, FIG. 5, and FIG. 6, (and in the examples of FIG. 9 and FIG. 10), as well as various other Figures. In the examples of FIG. 5 and FIG. 6, (and various other examples in the Figures), a portion or a whole of the catching area is curved. (This is an example of a portion or a whole of the catching area being sloped). However, such examples are not limited to being curved. For example, in FIG. 22, another example is shown of an example catching area, wherein a portion or a whole of the catching area is sloped. (Thus portion(s) that are sloped may be straight, (rather than curved). In other embodiments wherein a portion or a whole of the catching area 26 is sloped, it should be stated it is feasible there is a combination of both straight (and curved) portion(s)). A basic (cross-sectional) representation is shown of the example in FIG. 22. The example is shown from a front or back view. (In the examples of FIGS. 5 and 6, the examples are shown from a side view). In the example of FIG. 22, the example catching area is v-shaped. The example is not curved. nevertheless, it is an example of wherein a portion or a whole of the catching area is sloped. (Other examples may be substantially u-shaped for example. (It will be apparent that a wide array of designs and/or sizes and/or shapes may be possible/provided, not at all limited to these examples, which are provided by way of example only)).

Preferably the catching area comprises an aperture arrangement (ie at least one aperture 199), through which water can travel. In all the examples of FIGS. 5, 6 and 22, the catching area comprises an aperture arrangement, (and an example aperture can most visibly be seen in the examples of FIG. 5 and FIG. 22). In other examples, the aperture arrangement may comprise a plurality of apertures. (Thus the aperture arrangement may comprise a plurality of apertures, or there may be only one aperture). (It should be stated, an aperture arrangement may feasibly be provided with any embodiment of a catching area). (It should also be stated, the (or any) catching area may not comprise an aperture arrangement, (for water to travel through). For example, it has been disclosed, for example, how a catching area may fill with water, and may be manually removed, (by a user, for example). Thus embodiments may be provided wherein the (or any) catching area does not comprise a aperture arrangement, (for water to travel through, and leave the catching area)).

Most preferably, both a portion or a whole of the catching area is sloped, and the catching area comprises an aperture arrangement. It will be apparent that this can be extremely useful. The sloping (most clearly apparent in the design of the embodiment of FIG. 22), is able to direct water towards at least one aperture of the aperture arrangement. Thus the water can travel through, and leave the catching area. The portion or the whole of the catching area that is sloped may be sloped in one direction/orientation. The portion or the whole of the catching area that is sloped may be sloped in a plurality of directions/orientations. In the examples of FIG. 5 and FIG. 22, it is extremely apparent that (at least one aperture of) the aperture arrangement is located centrally (or very close to centrally). Thus this may be deemed to be an aperture 199 that is substantially central. (Thus, preferably at least one aperture of the aperture arrangement is substantially central). (It should also be stated, an aperture arrangement that comprises a plurality of apertures may be provided that is substantially central. (It should also be stated, it is also feasible an aperture arrangement may be provided wherein at least one aperture is substantially central, (but not all apertures are substantially central)). (The term 'substantially central' is a broad term, and may include being substantially central in any (or a plurality of) orientations), (eg from front to back of the catching area, (and/or from left to right of the catching area, for example). (In the examples of FIG. 5 and FIG. 22, at least one aperture 199 of the aperture arrangement is positioned between two sloped portions of the catching area. (Thus, preferably at least one aperture of the aperture arrangement is positioned between two sloped portions of the catching area. (In the examples of FIG. 5 and FIG. 22, at least one aperture 199 of the aperture arrangement is positioned between two opposingly sloped portions of the catching area). (If at least one aperture of the aperture arrangement is positioned between two sloped portions of the catching area, preferably at least one of the at least one aperture that is positioned between two sloped portions is positioned substantially centrally between the two clopped portions. An example of this is shown in both the example embodiment of FIG. 5, and of FIG. 22, for example). However, the aperture arrangement need not be central, (and it is not required that at least one aperture is positioned substantially centrally). For example, the example aperture in the example of FIG. 6 is not substantially central. Preferably at least one aperture of the aperture arrangement is substantially central. Preferably the aperture arrangement, (whether it comprises a plurality of apertures, or if there is just one aperture), is substantially central. (Thus, if the aperture arrangement comprises a plurality of apertures, preferably at least one aperture is substantially central. If there is only one aperture, preferably it is substantially central. (If the aperture arrangement comprises a plurality of apertures, they may all feasibly be substantially central). It should also be stated, the aperture arrangement is in no way limited to being substantially central. For example, an aperture arrangement may be provided wherein no aperture is substantially central. (Thus the (or any) aperture is not limited to being provided substantially centrally). (Thus, for example, there may be provided at least one aperture that is not substantially central).

(It is feasible the (or any) catching area may be sloped in more than two (or all) orientations/directions. For example, the examples of FIG. 5 and FIG. 6, for example, aside from being sloped (curved, in the example) from front and back (shown from the side view shown in FIG. 5 and FIG. 6), may also feasibly be sloped (eg curved, in the example), from left and/or right, (not visible from the view shown), or may not be sloped from left and/or right, for example).

A preferred position/location of the example catching areas is shown in various of the Figures, (eg FIG. 5 and FIG. 6). Preferably the example catching area of FIG. 22 is positioned in a similar position to the example catching areas of FIG. 5 and FIG. 6. (However, it will be apparent, (and is apparent in light of the disclosure/nature of the present application), that the (or any) catching area is not at all limited to the positions shown, and may be provided at various positions/locations, in various different embodiments. This will be apparent, in light of the nature of the disclosure). As stated, preferably the example catching area of FIG. 22 is positioned in a similar position to the example catching areas of FIG. 5 and FIG. 6. (Whilst the view of the example catching areas of FIG. 5 and FIG. 6 is shown from a side view (of the example catching areas), the view shown of the example catching area of FIG. 22 is from a front, or back, view, (and thus is a view from a substantially perpendicular angle to the view of the examples of FIG. 5 and FIG. 6). Thus the example of FIG. 22 is shown from an angle/view more akin to the angle/view of FIG. 4, for example. Thus it is preferably positioned in a similar position to the examples of FIG. 5, and FIG. 6, (and preferably travels across (from left to right) in terms of reference to the orientation/view shown in the example of FIG. 4). (It may, or may not, be wider, across, than the shower floor is. (It may be as wide, wider, or feasibly less wide, across, than the shower floor). This may apply to any embodiment of the (or any) catching area, and may apply to any position the (or any) catching area is provided, (and any view/orientation considered, for example).

Having travelled through the aperture arrangement, (ie at least one aperture of the aperture arrangement), water may, or may not, then travel through a channel(s). In the examples of FIG. 5 and FIG. 6, it is apparent that water, having travelled through the example aperture of the aperture arrangement, travels through a substantially downward channel. (However, the or any channel(s) that the water travels through, (after travelling through at least one aperture of the aperture arrangement), are not limited to being substantially downward, and may be provided in differing shapes and/or directions and/or orientations, etc from the examples provided). In the examples, the water than travels into (and thus will travel through) an example flush channel 99 of the toilet. (The example flush channel is provided by way of example only, and it will be apparent that the (or any) flush channel may be provided in differing shapes and/or directions and/or orientations, etc from the examples provided). (It should be noted, the examples provided are provided by way of example only, and no undue limitation should be read onto them (and/or the disclosure), (eg that the features must all be provided, for example). For example, in other embodiments, the example substantially downward channel may not be provided, and the water may travel through at least one aperture of the aperture arrangement of the catching area, and directly into another channel (eg the (or any) flush channel, (or any channel(s) at all, (not limited to a flush channel, for example)). In other examples, water that travels through at least one aperture of the aperture arrangement of the catching area may not travel through any channels after having travelled through the at least one aperture of the aperture arrangement. Thus various embodiments may be provided and/or are possible/plausible).

Preferably the (or any) catching area is self-enclosing, (in the sense that it does not rely on any other surface(s), for (ie to define) its area for water to travel into). However, it is feasible it may rely on other surface(s). For example, in the examples of FIG. 5 and FIG. 6, (and various other examples), the catching area is preferably self-enclosing. (It can be seen, in the views of FIG. 5 and FIG. 6 that the example catching areas are self-enclosing at their example front and back, (from the side view shown). They are preferably both also self-enclosing, from left to right, (not visible from the angle/view shown in FIG. 5 and FIG. 6)). However, it is feasible, rather than being self-enclosing, that the left and/or right of the catching area is not self-enclosing, (eg it may rely on a wall(s), (eg side wall(s)), or even a side(s) of the shower, (or any other surface(s), to define its area for water to travel into. (These would be examples of wherein the catching area is not self-enclosing). Thus it may rely upon other surface(s), to define its area for water to travel into. (The example surface(s) are provided by way of example only, and it may rely on any feature(s), feasibly, not limited to the examples provided). Similarly, the example catching area of FIG. 22 is preferably self-enclosing. Thus the example catching area of FIG. 22 preferably does not rely on any other surface(s) to define it. However, it will be apparent, (due to the basic cross-sectional view shown), that the view shown in FIG. 22 does not show a front or back of the example catching area. It should be stated it is feasible that the (or any) catching area is not self-enclosing/enclosed at a back (and/or front) of the catching area. (As an example, if such an embodiment was provided for the example embodiment of FIG. 4, for example, the back of the catching area may, feasibly, rely on a back wall, for example, to define its area for water to travel into. (This is provided simply by way of example only). The front, and/or back, of the (or any) catching area may rely on another surface(s), to define its area for water to travel into). (So the same may be the case for the left and/or right, for example). (Thus the (or any) catching area preferably is self-enclosing, (not relying on any other surface(s), to define its area for water to travel into). (But it should also be stated, it is feasible, in other embodiments, that the (or any) catching area may rely on another feature(s), to define it)).

(If the (or any) catching area relies on any other surface(s), (to define its area for water to travel into), it is preferably water-tight to at least one (or all) of the surface(s) it relies on. (This may be useful in terms of stopping water escaping, for example). However, it is feasible, for example, that it may not be. Thus it may not be water-tight to at least one (or all) of the surface(s) it relies on. (This may facilitate water escaping the catching area, for example. (Thus this may provide a portion (or a whole) of an aperture arrangement, through which water can travel, (to leave the catching area))).

(Receiving areas of toilets tend to be longer than they are wide. An example of this is most clearly visible in the example of FIG. 20, for example, where, from the view shown, it is clear the receiving area is longer (from left to right, from the view shown), than it is wide. (Thus preferably the receiving area is longer than it is wide). However, it will be apparent that a wide array of sizes and/or shapes, etc for the/a receiving area may be provided, and the examples are provided by way of example only).

Figure 21:
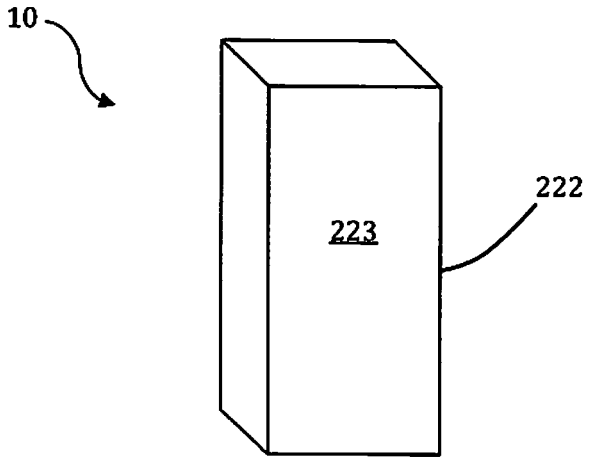
FIG. 21 is a perspective view of an example transportable container that contains a showering area and a toileting area of the combined shower and toilet arrangement on all sides.

In FIG. 21, an example is shown of an example container 222 that contains a showering area and a toileting area of the combined shower and toilet arrangement, on all sides. (In the present application, the area where the user showers may be generally referred to as the 'showering area'. In the present application, the area where the user toilets may be generally referred to as the 'toileting area'). In the example, the example container is enclosed on all sides. (Note, despite being enclosed on any side(s), there may be provided aperture(s) at any area of the container, (eg at any side, (and/or top and/or bottom)). Thus hole(s) for example, (or any opening(s)), may be provided, (which are examples of aperture(s)). This may feasibly aid air-flow, for example. Thus the fact that an embodiment encloses a showering area and a toileting area on all sides does not mean there cannot be hole(s), for example). (There maybe an openable and closable door. For example, (provided by way of example only), a portion or a whole of example face 223 of the example container 222 may be openable and closable, functioning as (and therefore being) a door). Preferably, the container is also enclosed at a top of the container. (This is the case, in the example shown). Preferably the container is also enclosed at a bottom of the container. (The bottom of the container may, or may not, act as the floor for the toilet, in use).

(The example container is shown being generally cubic in shape. However in other embodiments, it may be other shapes. For example, it may feasibly be round (or at least more rounded) in shape, for example).

(It should also be stated, any or all feature(s) disclosed in the present application, (for any embodiment(s) disclosed in the present application, for example), may be provided within the container, (and thus may be contained by the container). (Thus any feature(s)/definition afforded to any embodiment in the present application may feasibly be provided within the container). In the example shown, the container may be transported. Thus the example shown is an example of a transportable container).

(Broadly speaking, embodiments wherein there is provided a container, (eg the example embodiment as shown in FIG. 21, for example), may draw upon (and/or be afforded) any other feature(s)/disclosure of the present application. For example, (simply taken by way of example only), within the container, there may be provided a stopping arrangement (eg that that protrudes inwardly at a side of the shower), which the shower floor engages, to stop the shower floor in the shower use position. (The side(s) of the container may act as the side(s) of the shower, or may not—eg the side(s) of the shower could feasibly be contained within the container itself, or the container itself may act as the side(s) of the shower. Thus the side(s) of the shower may feasibly be provided by the container, (or may not). (This is just one example of a feature(s) disclosed (eg the stopping arrangement, in this example) that may be provided for such an embodiment). The container embodiment may be useful in various situations. It may, for example, be useful for festivals.

In Use

An example(s) will now be described in use, described by way of example only, referring to a particularly preferred embodiment(s), in no way limiting a scope of the invention.

Thus, referring in use (by way of example) to a particularly preferred example, the arrangement has two uses, that of a toilet and that of a shower. When using the toilet, if the embodiment is an enclosed embodiment, the user enters the enclosure with the (preferably twin) door(s) (preferably twin leaf doors) open (like that of a traditional shower, for example). If the user wants to use the toilet, (and the shower floor is in the non-use position), they can freely use the toilet, (*asper* a normal toilet, for example). Preferably a toilet paper roll can found behind the user (preferably on the underside of the shower floor) and be used in its usual manner once completed. Preferably, once the user has finished using the toilet, the user passes their hand over a touchless sensor, (preferably located the opposite side to that of the toilet roll), (and preferably also on the underside of the shower floor), and activates the toilet flush system.

If the user wants to use the shower, and the toilet, for example, has a seat and/or cover (ie lid) raised, in preferred embodiments, they now lower the seat and/or cover (ie lid), to make way for the shower floor. Likewise, in a similar movement to that of lowering the toilet seat and cover, in preferred embodiments, the shower floor can now be lowered. In lowering the shower floor, preferably a step(s) is deployed from the underside of the shower floor. Once lowered, the shower floor preferably fits tight with one or more (and preferably all) of the shower side(s), assuring/providing a waterproof barrier. The deployed step(s) allows access to the shower floor. The user steps up to the (preferably slightly angled) shower floor using the step(s). They may now close any door(s) of the shower, (eg twin leaf doors), so that shower water is contained in the confines of the shower. The user can then use the shower. The used shower water is then preferably diverted (by/from the shower floor) towards a channel located at the rear of the shower and then preferably into the water/toilet evacuation system. Once the user has finished having a shower, the user may open the door(s), (eg twin leaf doors), may descend any step(s). They may then move the shower to its non-use mode/position. Preferably any step(s) fold up with the shower floor, and the arrangement can now be used as a toilet.

It should be stated, once again, that the example(s) described, in use, is described simply by way of example only, referring to a particularly preferred embodiment(s), and in no way limiting a scope of the invention.

Thus an example(s) has been described, in use.

The embodiments described above are provided by way of example only, and various other modifications will be apparent to persons skilled in the art without departing from the scope of the invention as defined in the appended claims.

Broader and/or Different Invention(s) May be Claimed (and are Supported)

The appended claims define limited inventions. However, it should be recognized and understood that the disclosure of the present application includes a vast array of inventions, not limited to inventions set out in the appended claims and/or any statement(s) of invention.

For example, if the present disclosure of the present application (inclusive of drawing(s) and/or description) discloses features a to z, it should be recognized and understood that any invention may be claimed, comprising any feature(s) out of features a to z. Thus if the/an appended claim 1 defines the invention claimed as comprising essential features a, b, and c, it should be understood that an invention may be claimed comprising solely feature a, or solely feature b, or solely feature c, or any combination of features a, b, and c. Furthermore, it should be understood that an invention may be claimed comprising any of feature(s) d to z, whether or not also comprising any of features a, b, or c.

Furthermore, no feature disclosed is limited to only being set forth in a claim when used in conjunction with other particular feature(s) it is disclosed with in the specification, but may be claimed with any other feature or combination of features disclosed in the present application. Thus if a feature is disclosed 'clustered' with several other feature(s) when disclosed in the specification, the applicant(s) nevertheless reserves the right to 'extract' that feature(s) from the several other feature(s) it is disclosed with, and set it forth in a claim, combined with any other feature(s) disclosed in the present application, which other feature(s) may, or may not, also be 'extracted' from any other feature(s) they are clustered with in the disclosure of the present application. Thus any permutation/combination of features may be claimed for patent in a future claim and/or patent application.

A final claim may be appended, defining/claiming: 'Any novel subject matter or combination including novel subject matter disclosed herein, whether or not within the scope of or relating to the same invention as claimed in any of the preceding claims.', which serves to signify that the applicant(s) reserves the right to claim any invention (ie 'thing'), comprising any feature, or combination of features, disclosed in the present application (inclusive of drawing(s) and/or description). (The applicant(s) reserves this right, whether or not such a claim is appended). This statement (and/or final appended claim), if so desired, should be seen as a statement of invention, stating any invention (ie 'thing'), comprising any feature, or combination of features disclosed in the present application (in any permutation/combination). The applicant(s) reserves the right to claim any (such) invention (ie 'thing'), and considers an objection by a patent office/examiner (stating that such an invention is not supported by/disclosed in the present application) to be in direct conflict with this statement of invention. Thank you to the relevant patent office/examiner for taking note of this. It is intended (or plausible) that such invention(s) may be claimed in a future application(s) which claims benefit of priority of the present application, or, for example, in future filed claims of the present application. The present disclosure of the present application supports such invention(s)/claim(s).

Adjectival and Adverbial Use, in the Present Application, is Innately Optional

In the present application, adjectival definition of a noun in no way limits the ability to claim the noun, without the adjective. Thus if a 'curved edge' is disclosed, it should be understood that it is disclosed simply by way of example, as an embodiment of 'an edge', and that an invention may be claimed, comprising an 'edge', and not limited to comprising a 'curved edge', even if the only disclosure in the specification is of a 'curved edge'. This goes for every single adjective example in the present application, and also applies to adverbs in the same way, with reference to how they limit a broader verb/action, which verb/action/characterizing feature may be included in a claim (and is supported), not limited by the adverb that further defines it.

The Title of the Present Application does not Limit What May be Claimed

The title of the present application (and the claims presented) do not limit what may be claimed futurely, based upon (and supported by) the present application. For example, if the title is 'Pet Cleaning Apparatus', even if all disclosure in the patent application relates to a pet cleaning apparatus (as do the claims), nevertheless, a 'cleaning apparatus' may be claimed (not limited to being for pets), as it is clear a 'pet cleaning apparatus' is an embodiment of a 'cleaning apparatus'. As stated previously, in the present application, adjectival definition of a noun in no way limits the ability to claim the noun, without the adjective. This also applies to the title. Furthermore, an invention may be claimed comprising any feature, or combination of features, disclosed in the present application.

Any Feature Disclosed May be More Broadly Defined/Claimed as a Feature/Arrangement Any feature (for/with a given purpose) disclosed in the present application, whatever it is disclosed or defined as, may be more broadly defined in a claim as a feature (or arrangement) for the given purpose. Thus, if, for example, in the present application, a 'pin' is disclosed, for holding element 'a' and element 'b' together, such disclosure supports definition in a claim (in this, or a future patent application that claims benefit of priority to the present patent application) of a 'holding feature' (or 'holding arrangement'), for holding element 'a' and element 'b' together. This is the case for all feature(s)/disclosure, even including feature(s) defined in any statement(s) of invention and/or title of the invention.

Feature(s) Shown in the Drawings May be Combined to Form an Invention

Any feature(s) or combination of feature(s) shown in any drawing(s) may be combined with any other feature(s) or combination of feature(s) shown in any other drawing(s), to form an invention, which may be claimed. This may be the case for any embodiment shown in any drawing(s), and applicant(s) reserves the right to claim any such invention(s). Furthermore, such feature(s) may, of course, be combined with any other feature(s) and/or disclosure of the present application, to form an invention(s), which may be claimed. Such an invention(s) may be claimed in a future application(s) which claims benefit of priority of the present application, or, for example, in future filed claims of the present application. The present disclosure of the present application supports such invention(s)/claim(s).

The invention claimed is:

1. A combined shower and toilet arrangement, comprising:

a shower, comprising: a shower fluid outputting arrangement; and a shower floor; and: a toilet, comprising a receiving area for receiving human waste; wherein the combined shower and toilet arrangement is operable in a shower use mode or a toilet use mode, wherein: in the toilet use mode, the shower floor is in a position that does not obstruct use of the toilet, and is in a non-use position, not usable as a floor for the shower; and in the shower use mode, the shower floor is in a shower use position, above a portion or a whole of the receiving area of the toilet, and is usable as a floor for the shower, the shower floor being rotatably movable from the non-use position to the shower use position; and from the shower use position to the non-use position such that the rotational movement alone places the shower floor in the shower use position;

the combined shower and toilet arrangement further comprising a catching area in the form of a gutter configured to receive water from the shower floor when the shower floor is in both the use and non-use position, the catching area not being the receiving area of the toilet, the catching area being lower than a portion or a whole of an underside of the shower floor and being located in a vicinity of an axis of rotation of the shower floor; and wherein the gutter is located at a rear of the toilet receiving area and the gutter forms part of the shower floor.

2. A combined shower and toilet arrangement as claimed in claim 1, wherein the combined shower and toilet arrangement comprises a stopping arrangement that protrudes inwardly at a side of the shower, and which the shower floor engages, to stop the shower floor in the shower use position.

3. A combined shower and toilet arrangement as claimed in claim 1, further comprising a channel arrangement, through which water from the shower is directed, wherein a portion or a whole of the channel arrangement is lower than a portion or whole of an underside of the shower floor, with reference to the shower floor when in the shower use position.

4. A combined shower and toilet arrangement as claimed in claim 1, wherein a water tank of the toilet is behind a wall, and is thus not within the shower.

5. A combined shower and toilet arrangement as claimed in claim 1, wherein there is provided on the shower floor at least one of: a toilet paper holder; a user means, to activate flushing of the toilet.

6. A combined shower and toilet arrangement as claimed in claim 1, wherein there is provided on an underside of the shower floor at least one of: a toilet paper holder; a user means, to activate flushing of the toilet.

7. A combined shower and toilet arrangement as claimed in claim 1, wherein there is provided a transportable container that contains a showering area and a toileting area of the combined shower and toilet arrangement on all sides.

8. A combined shower and toilet arrangement as claimed in claim 1, wherein, in the shower use mode, a portion or a whole of the shower floor is sloped, to facilitate directing water from the shower floor, and wherein, due to the portion or the whole of the shower floor being sloped, water from the shower floor is directed at least one of: off a side of the shower floor; through an aperture arrangement in the shower floor, wherein the aperture arrangement is not positioned above the receiving area of the toilet.

9. A combined shower and toilet arrangement as claimed in claim 8, wherein, due to the portion or the whole of the shower floor being sloped, water from the shower floor is directed off the side of the shower floor.

10. A combined shower and toilet arrangement as claimed in claim 1 further comprising a support arrangement connected to the shower floor wherein the support arrangement is at least one of: collapsible to save space in the toilet use mode and rotatable towards the shower floor to save space in the toilet use mode.

11. A combined shower and toilet arrangement as claimed in claim 10 wherein the support arrangement includes at least one step.

12. A combined shower and toilet arrangement comprising:

a shower, comprising: a shower fluid outputting arrangement; and a shower floor; and: a toilet, comprising a receiving area for receiving human waste; wherein the combined shower and toilet arrangement is operable in a shower use mode or a toilet use mode, wherein: in the toilet use mode, the shower floor is in a position that does not obstruct use of the toilet, and is in a non-use position, not usable as a floor for the shower; and in the shower use mode, the shower floor is in a shower use position, above a portion or a whole of the receiving area of the toilet, and is usable as a floor for the shower, the shower floor being rotatably movable from the non-use position to the shower use position; and from the shower use position to the non-use position such that the rotational movement alone places the shower floor in the shower use position;

the combined shower and toilet arrangement further comprising a catching area in the form of a gutter configured to receive water from the shower floor when the shower floor is in both the use and non-use position, the catching area not being the receiving area of the toilet, the catching area being lower than a portion or a whole of an underside of the shower floor and being located in a vicinity of an axis of rotation of the shower floor;

wherein, in the shower use mode, a portion or a whole of the shower floor is sloped, to facilitate directing water from the shower floor, and wherein, due to the portion or the whole of the shower floor being sloped, water from the shower floor is directed at least one of: off a side of the shower floor; through an aperture arrangement in the shower floor;

wherein due to the portion or the whole of the shower floor being sloped, water from the shower floor is directed through the aperture arrangement in the shower floor, the aperture arrangement not being positioned above the receiving area of the toilet.

13. A combined shower and toilet arrangement comprising:

a shower, comprising: a shower fluid outputting arrangement; and a shower floor; and: a toilet, comprising a receiving area for receiving human waste; wherein the combined shower and toilet arrangement is operable in a shower use mode or a toilet use mode, wherein: in the toilet use mode, the shower floor is in a position that does not obstruct use of the toilet, and is in a non-use position, not usable as a floor for the shower; and in the shower use mode, the shower floor is in a shower use position, above a portion or a whole of the receiving area of the toilet, and is usable as a floor for the shower, the shower floor being rotatably movable from the non-use position to the shower use position; and from the shower use position to the non-use position such that the rotational movement alone places the shower floor in the shower use position;

the combined shower and toilet arrangement further comprising a catching area in the form of a gutter configured to receive water from the shower floor when the shower floor is in both the use and non-use position, the catching area not being the receiving area of the toilet, the catching area being lower than a portion or a whole of an underside of the shower floor and being located in a vicinity of an axis of rotation of the shower floor; and wherein the gutter is located at a rear of the toilet receiving area; and wherein the shower floor is watertight to a portion or a whole of a perimeter of the shower by way of a seal arrangement.

14. A combined shower and toilet arrangement as claimed in claim 13 wherein the gutter forms part of the shower floor.

* * * * *